US009874026B2

(12) United States Patent
Bilge

(10) Patent No.: US 9,874,026 B2
(45) Date of Patent: Jan. 23, 2018

(54) SYSTEM AND METHOD FOR MOUNTING WALL PANELS SECURED TO A WALL

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 0 days.

(21) Appl. No.: 15/067,955

(22) Filed: Mar. 11, 2016

(65) Prior Publication Data

US 2017/0260752 A1 Sep. 14, 2017

(51) Int. Cl.
*E04B 2/30* (2006.01)
*E04F 13/08* (2006.01)

(52) U.S. Cl.
CPC ..... *E04F 13/0803* (2013.01)

(58) Field of Classification Search
CPC ..... E04F 13/0803
USPC ..... 52/483.1, 458, 302.1
See application file for complete search history.

(56) References Cited

U.S. PATENT DOCUMENTS 2,607,971 A * 8/1952 Bedford, Jr. ..... E04F 13/0842 24/458
3,807,100 A * 4/1974 Kuss ..... E04B 1/24 52/2.11
6,745,527 B1 * 6/2004 Sherman ..... E04B 2/96 52/235
7,210,273 B2 * 5/2007 Zahner, III ..... E04D 3/30 52/302.1
8,739,483 B1 6/2014 Bilge
8,833,015 B2 9/2014 Bilge
8,925,271 B1 1/2015 Bilge
8,966,849 B1 3/2015 Bilge
2009/0241451 A1 * 10/2009 Griffiths ..... E04F 13/081 52/309.4

* cited by examiner

*Primary Examiner* — Basil Katcheves
(74) *Attorney, Agent, or Firm* — Richard M. Goldberg

(57) ABSTRACT

A system for mounting wall panels to an existing wall, includes fastening extrusions, each including an extrusion base section adapted to be secured to the existing wall, at least one retaining wall extending at an angle from the base section, and a holding member on each retaining wall; and intermediary supports for supporting the wall panels at a position between side edges of the wall panels, each intermediary support including an intermediary support base plate adapted to be secured to the existing wall, and a sliding member adapted to be slidably connected with the base plate, such that one wall panel is adapted to be secured on the sliding member for sliding movement relative to the intermediary support base plate with the sliding member in order to slide a side edge of the wall panel into one fastening extrusion between the extrusion base section and the holding member.

16 Claims, 31 Drawing Sheets

20''
32''
33''
33b''
33a''
35''
36''
37''
34''
26''

20''
32''
33b''
33''
26''
36''
35''
33a''
37''
34''

22''
56''
54''
46''
57''
53a''
55''
52''
53b''
53''

22a''
54''
57''
46''
56''
55''
52''
51b''
55''
53a''
53''
53b''
51''
51a''

56''
57''
46''
51b''
52''
53''
51a''
55''
53''
51''
22a''

54''
46''
57''
56''
55''
53a''
52''
22''
53b''
53''

SYSTEM AND METHOD FOR MOUNTING WALL PANELS SECURED TO A WALL

REFERENCE TO RELATED APPLICATION

The present application is a continuation-in-part of U.S. patent application Ser. No. 15/047,024, filed Feb. 18, 2016 and entitled THERMAL BREAK SYSTEM FOR WALL PANELS SECURED TO AN EXISTING WALL, the entire disclosure of which is incorporated herein by reference.

BACKGROUND OF THE INVENTION

The present invention relates generally to a wall system, and more particularly, to a system for easily mounting wall panels over an existing wall.

In order to enhance the look of a wall structure, it is known to secure decorative wall panels to the wall structure. However, the securement of wall panels to the wall structure is generally a long and tedious job since it entails using fastening devices such as nails and/or screws to secure the walls panels directly to the wall structure. In addition, the fastening devices are exposed, which can provide an unsightly appearance.

A system that overcomes these problems is disclosed in U.S. Pat. Nos. 8,833,015, 8,739,483, 8,925,271 and 8,966,849; and pending U.S. patent application Ser. Nos. 14/044,606, 14/256,384, 14/641,097 and 14/667,297 to the same inventor herein, the entire disclosures of which are incorporated herein by reference. In these patents, each wall panel includes a main panel section and at least two bent end sections bent at a right angle in the same direction, at edges of the main panel section. Each bent end section includes a cut-out section or recess at an inner surface thereof. A fastening extrusion is secured to an existing wall for receiving the bent end sections. The fastening extrusion includes a base section and flexible and resilient bent end securing walls extending outwardly therefrom. Each bent end securing wall includes a projection on an outer surface thereof. When the bent end sections are forced in a direction toward the existing wall, the bent end sections force the respective bent end securing walls to bias away until the projections are in line with the cut-out sections or recesses, whereupon the bent end securing walls snap back to their original position in which the projections are engaged in the cut-out sections or recesses.

However, the above system utilizes bent end sections at the edges of the main panel section. This increases the material that must be used, and makes the construction more complicated.

It would therefore be desirable to provide wall panels which do not require the bent end sections, but which can easily be installed over an existing wall.

SUMMARY OF THE INVENTION

Accordingly, it is an object of the present invention to provide a system and method for easily mounting wall panels over an existing wall that overcomes the aforementioned problems.

It is another object of the present invention to provide a system and method for easily mounting wall panels over an existing wall, which utilizes a simple sliding action for assembling the wall panels.

It is still another object of the present invention to provide a system and method for easily mounting wall panels over an existing wall which provides support at an intermediate position of the wall panels where the sliding action occurs.

It is yet another object of the present invention to provide a system and method for easily mounting wall panels over an existing wall which easily captures and restrains ends of the wall panels.

It is a further object of the present invention to provide a system and method for easily mounting wall panels over an existing wall which allows for thermal expansion of the wall panels.

In accordance with an aspect of the present invention, a system for mounting wall panels to an existing wall, includes a plurality of fastening extrusions, each fastening extrusion including an extrusion base section adapted to be secured to the existing wall, at least one retaining wall extending at an angle from the base section, and a holding member on each retaining wall; and a plurality of intermediary supports for supporting the wall panels at a position between side edges of the wall panels, each intermediary support including an intermediary support base plate adapted to be secured to the existing wall, and a sliding member adapted to be slidably connected with the base plate, such that one wall panel is adapted to be secured on the sliding member for sliding movement relative to the intermediary support base plate with the sliding member in order to slide a side edge of the wall panel into one fastening extrusion between the extrusion base section and the holding member.

The holding member of each fastening extrusion preferably includes either an enlarged section extending along an upper end of each retaining wall, or a hold down wall connected at the upper end of each retaining wall and extending in spaced relation with the extrusion base section.

The at least one fastening extrusion includes at least one corner fastening extrusion, and at least one main fastening extrusion.

In one embodiment, at least one fastening extrusion includes two parallel, spaced apart retaining walls extending at an angle from the base section, with each retaining wall including one holding member.

In one embodiment, at least one fastening extrusion includes a bend in the extrusion base section thereof which is bent toward a respective holding member to form a gap therebetween to receive one side edge of one wall panel.

In another embodiment, each wall panel is formed by a core with a thin metal wall covering opposite sides thereof; and at least one fastening extrusion includes a bulge in at least one retaining wall thereof against which only the core is adapted to engage in order to allow for thermal expansion of the thin metal walls.

There is also a closure member for covering each fastening extrusion, the closure member engaging at least one of at least one retaining wall, and at least one holding member.

The intermediary support base includes a base plate adapted to be secured to the existing wall, a first retaining wall connected with a first side of the base plate, and a second retaining wall connected with a second opposite side of the base plate; and the sliding member includes a central member dimensioned to fit between the first and second retaining walls, a first wing member at a first side of the central member for engagement within the first retaining wall, and a second wing member at a second opposite side of the central member for engagement within the second retaining wall. Preferably, the first and second retaining walls each have a widthwise dimension, and the widthwise dimension of the first retaining wall is less than the widthwise dimension of the second retaining wall, and the first and second wing members each have a widthwise dimension, and the widthwise dimension of the first wing member is less than the widthwise dimension of the second wing member.

There is also a thermal insulation member for positioning between the existing wall and each extrusion base and each intermediary support base.

In another embodiment, a furring member is connected between the existing wall and each fastening extrusion and intermediary support. Each furring member includes at least one foot wall adapted to be connected to the existing wall, at least one spacing wall having one end connected to the at least one foot wall and extending in a direction transverse to the at least one foot wall and the existing wall, and a connection wall connected to an opposite end of the at least one spacing wall and extending in a direction transverse to the at least one spacing wall for connection to each fastening extrusion and each intermediary support.

In accordance with another aspect of the present invention, a method is provided for mounting wall panels to an existing wall, with a system of the type including a plurality of fastening extrusions, each fastening extrusion including an extrusion base section adapted to be secured to the existing wall, at least one retaining wall extending at an angle from the base section, and a holding member on each retaining wall; a plurality of intermediary supports for supporting the wall panels at a position between side edges thereof, each intermediary support including an intermediary support base adapted to be secured to the existing wall, and a sliding member adapted to be slidably connected with the base plate, such that one wall panel is adapted to be secured on the sliding member for sliding movement relative to the intermediary support base plate with the sliding member in order to slide a side edge of the wall panel into one fastening extrusion between extrusion base section and the holding member. The method includes the steps of a) securing a first the fastening extrusion to the existing wall; b) securing the intermediary support base plate of at least one intermediary structural support assembly to the existing wall in spaced relation from the first fastening extrusion; c) slidably assembling a sliding member with the secured intermediary support base plate so that the sliding member is positioned to one side in the intermediary support base plate in a direction away from the first fastening extrusion; d) securing one wall panel on the sliding member for sliding movement relative to the intermediary support base plate with the sliding member, such that one side edge of the wall panel is in spaced relation to one retaining wall of the first fastening extrusion; e) moving the wall panel toward the first fastening extrusion such that the sliding member moves to an opposite side of the intermediary support base plate and such that the one side edge of the wall panel is moved into at least close abutment to one retaining wall of the first fastening extrusion below the holding member thereof; f) positioning a second fastening extrusion against the existing wall, such that an opposite side edge of the wall panel is in at least close abutment to one retaining wall of the second fastening extrusion; and g) continually repeating steps b)-f).

The first fastening extrusion is a corner fastening extrusion and the second the fastening extrusion is a main fastening extrusion.

The method further includes the step of assembling a closure member with the holding members and/or the retaining members of the respective fastening extrusion.

The method further includes the steps of h) securing a third fastening extrusion to the existing wall at right angles to the first fastening extrusion prior to the step a); and i) moving the wall panel toward the third fastening extrusion when the wall panel is moved toward the first fastening extrusion such that one end edge of the wall panel is moved into at least close abutment to one the retaining wall of the third fastening extrusion below the holding member thereof.

In accordance with still another aspect of the present invention, a system for mounting wall panels to an existing wall, includes a plurality of supports for mounting the wall panels on the existing wall. Each support includes a support base plate member adapted to be secured to the existing wall, and a sliding member adapted to be slidably connected with the base plate, such that one wall panel is adapted to be secured on the sliding member for sliding movement relative to the intermediary support base plate with the sliding member in order to slide a side edge of the wall panel into one fastening extrusion between the extrusion base section and the holding member. Each support base plate member includes a base plate adapted to be secured to the existing wall, a first retaining wall connected with a first side of the base plate, and a second retaining wall connected with a second opposite side of the base plate. Each sliding member includes a central member dimensioned to fit between the first and second retaining walls, a first wing member at a first side of the central member for engagement within the first retaining wall, and a second wing member at a second opposite side of the central member for engagement within the second retaining wall.

The first and second retaining walls each have a widthwise dimension, and the widthwise dimension of the first retaining wall is less than the widthwise dimension of the second retaining wall, and the first and second wing members each have a widthwise dimension, and the widthwise dimension of the first wing member is less than the widthwise dimension of the second wing member.

In this embodiment, adjacent side edges of adjacent wall panels are in at least near abutting relation with each other. In such case, there is further provided a connector for connecting together the adjacent side edges.

In a modification, a stop limiter is connected with the first retaining wall for providing a stop against which an edge of a respective wall panel abuts.

In a further modification, each wall panel has side edges with slots therein, and each stop limiter includes a wall for insertion in a respective slot.

Further, each sliding member is movable in at least two different directions relative to its respective support base plate member.

In accordance with still another aspect of the invention, a method is provided for mounting wall panels to an existing wall, with a system of the type including a plurality of intermediary supports for supporting the wall panels at a position between side edges thereof, each the intermediary support including an intermediary support base adapted to be secured to the existing wall, and a sliding member adapted to be slidably connected with the base plate, such that one the wall panel is adapted to be secured on the sliding member for sliding movement relative to the intermediary support base plate. The method includes the steps of a) securing the intermediary support base plate of at least one intermediary structural support assembly to the existing wall; b) slidably assembling a sliding member with the secured intermediary support base plate so that the sliding member is positioned to one side in the intermediary support base plate; c) securing one wall panel on the sliding member for sliding movement relative to the intermediary support base plate with the sliding member; d) moving the wall panel such that the sliding member moves to an opposite side of the intermediary support base plate; and e) continually repeating steps a)-d), such that adjacent edges of adjacent wall panels are adjacent to each other.

The above and other features of the invention will become readily apparent from the following detailed description thereof which is to be read in connection with the accompanying drawings.

BRIEF DESCRIPTION OF THE DRAWINGS

FIG. 30 is a perspective view of another modification of the embodiment of FIG. 29, with a further thermal break attachment;

DETAILED DESCRIPTION

Figure 1:
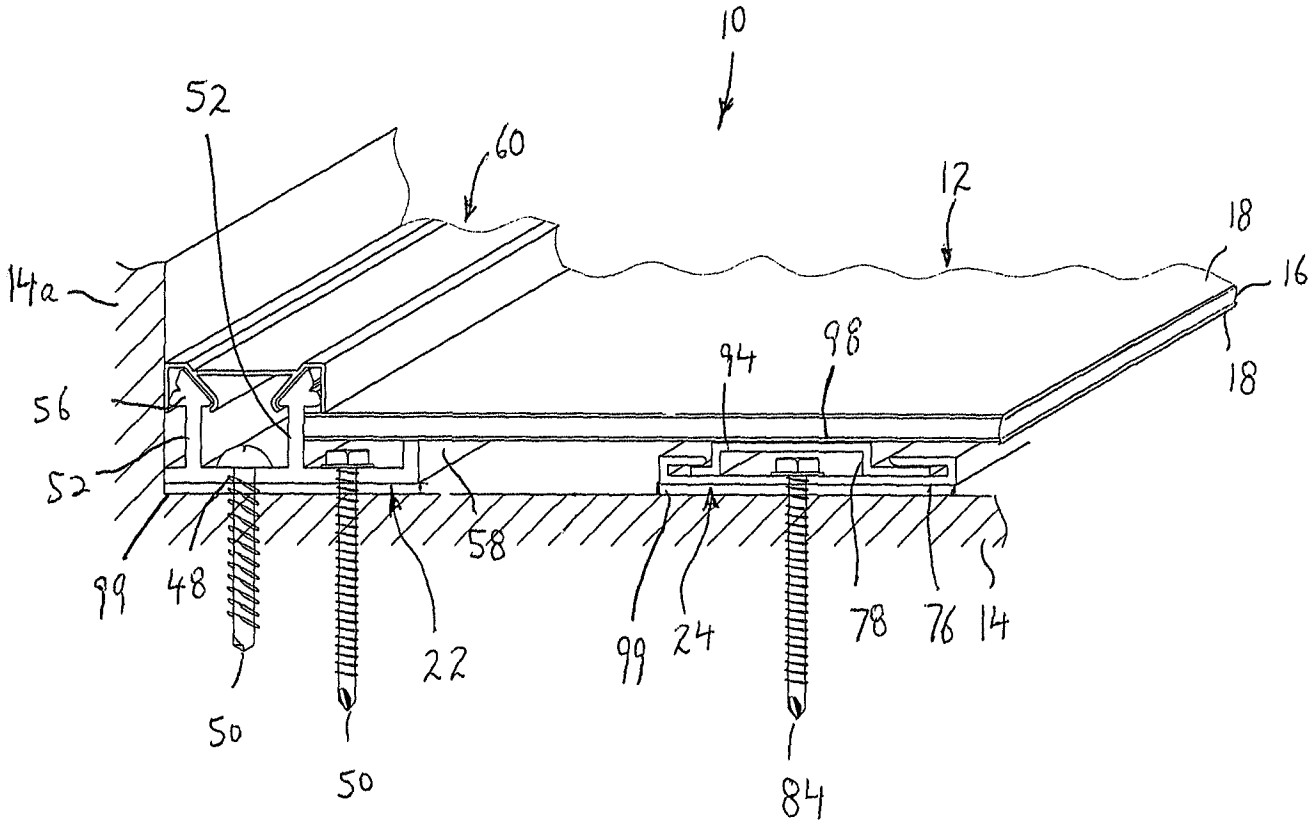
FIG. 1 is a perspective view of a system for easily mounting wall panels over an existing wall, showing securement of a first wall panel at a corner.

Referring to the drawings in detail, and initially to FIGS. 1-4, there is shown a system 10 for easily mounting wall panels 12 over an existing wall 14, which preferably includes any planar wall. Each panel 12 preferably has a rectangular parallelepiped shape, although the present invention is not limited thereby. Although wall panel 12 is shown to be planar, in fact, it can have different shapes, such as a wave shape, etc. to provide different aesthetic appearances. Wall panels 12 are formed preferably by, but not limited to, a polyethylene core 16 with a thin aluminum wall 18 covering opposite sides thereof.

In order to secure wall panels 12 in covering relation to existing wall 14, system 10 includes elongated main fastening extrusions 20, elongated corner fastening extrusions 22 and elongated intermediary structural support assemblies 24, which can be made of any suitable material, such as aluminum, polyvinyl chloride (PVC) or the like.

Figure 2:
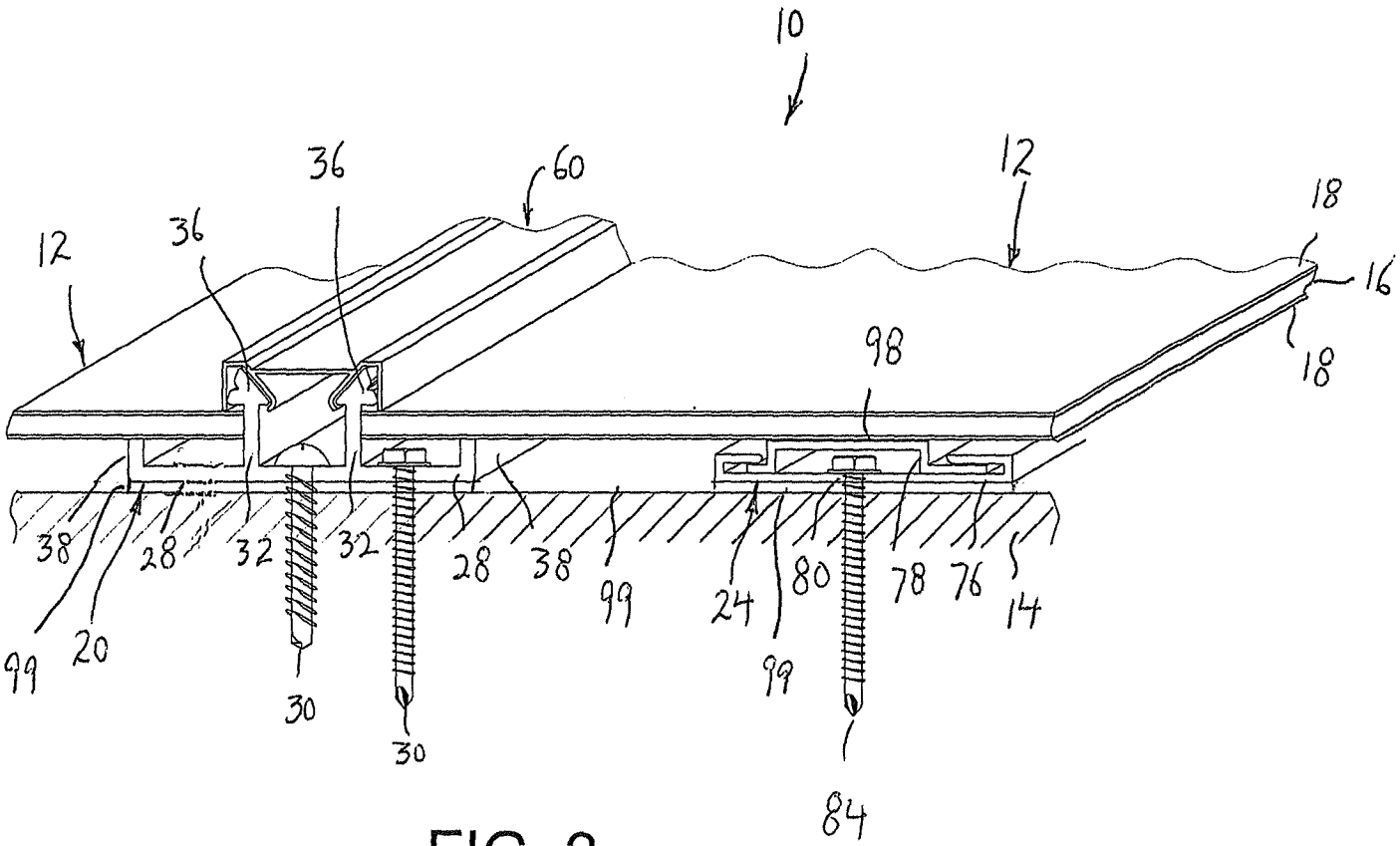
FIG. 2 is a perspective view of the system for easily mounting wall panels over an existing wall, showing securement of a second wall panel adjacent the first wall panel.
Figure 4:
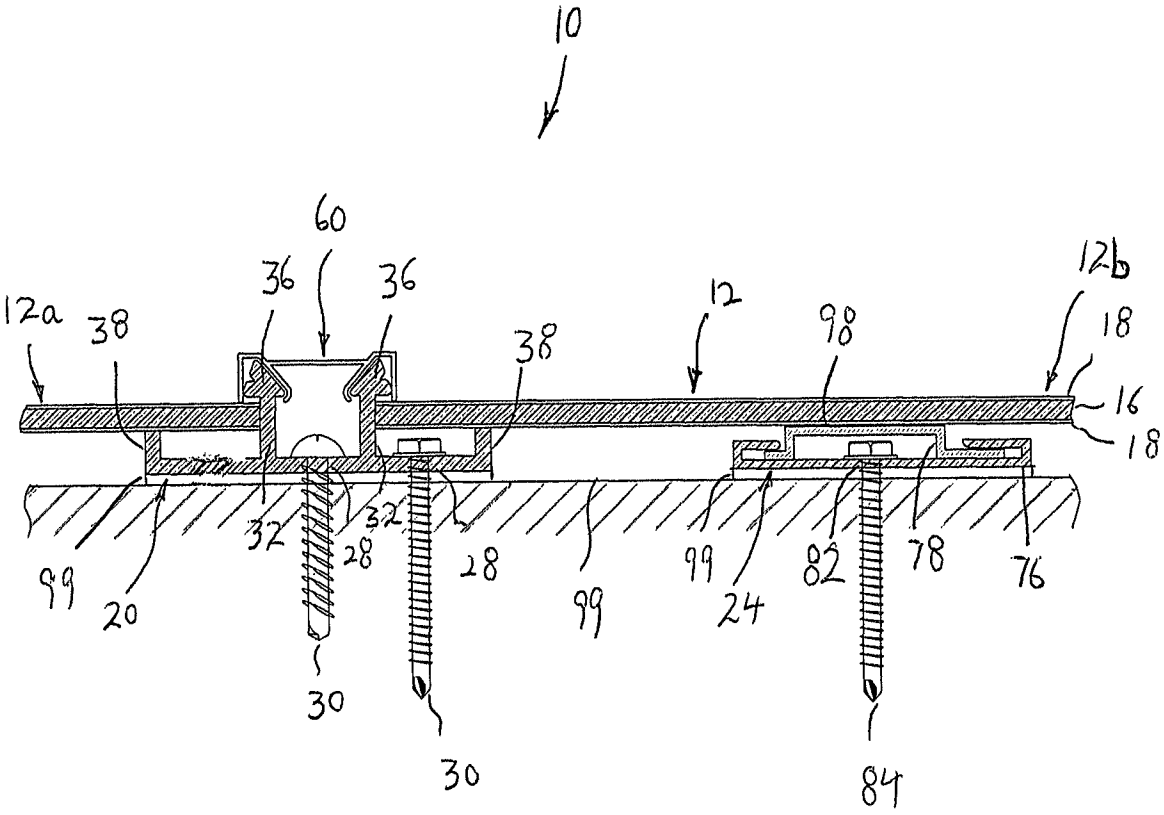
FIG. 4 is a cross-sectional view of the system of FIG. 2.
Figure 7:
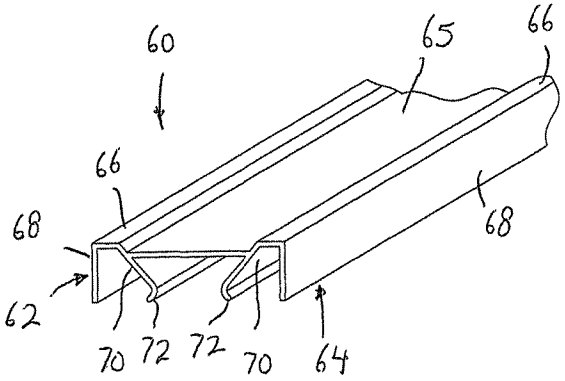
FIG. 7 is a perspective view of a closure member for use with the fastening extrusions of FIGS. 5 and 6.
Figure 6:
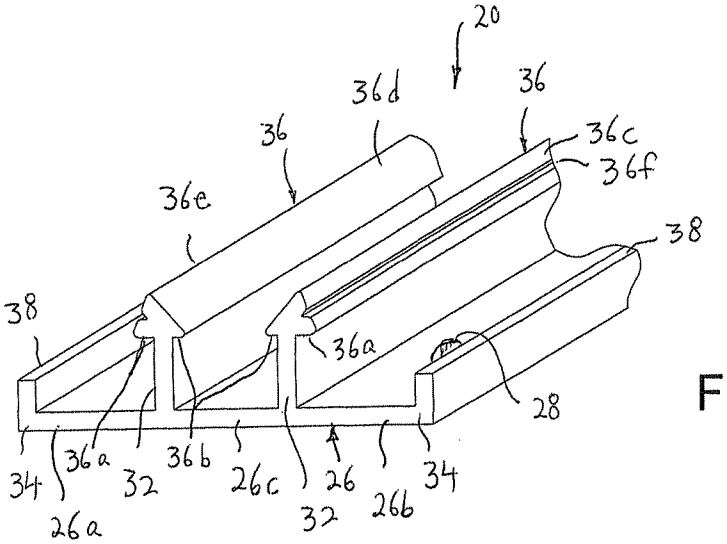
FIG. 6 is a perspective view of the main fastening extrusion of FIG. 2.
Figure 8:
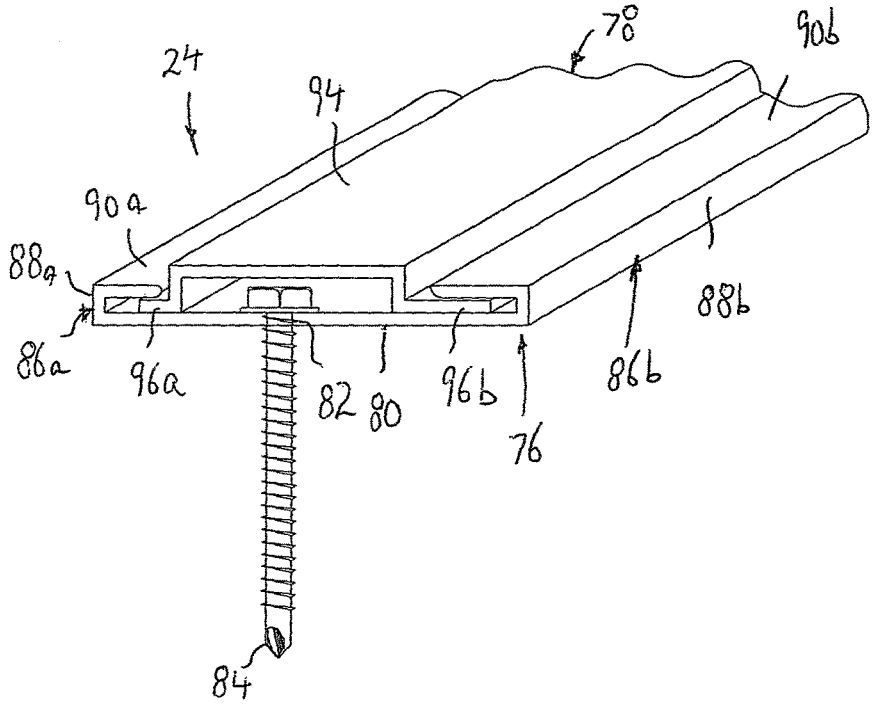
FIG. 8 is a perspective view of the structural support assembly of FIGS. 1 and 2 in a finally assembled condition.
Figure 9:
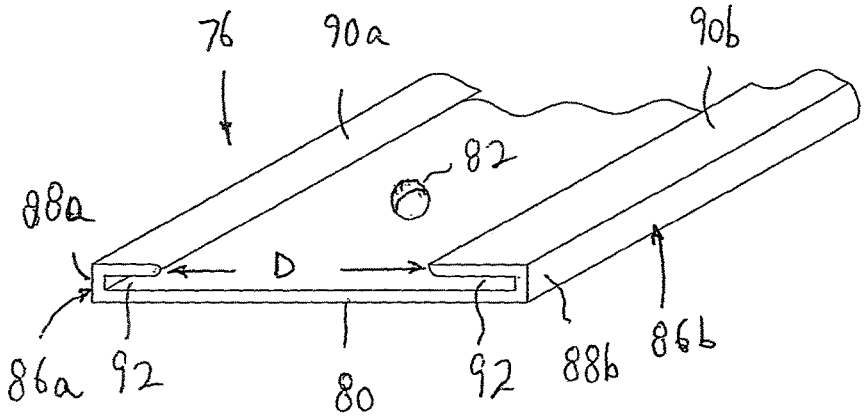
FIG. 9 is a perspective view of the base support of the structural support assembly of FIG. 8.
Figure 10:
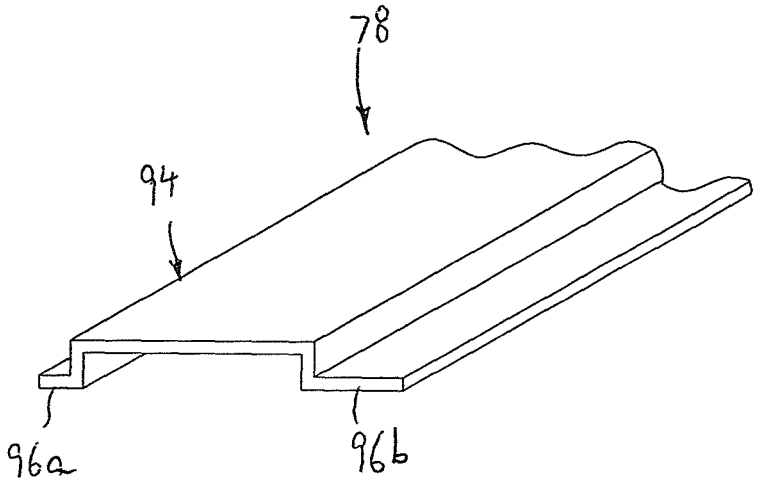
FIG. 10 is a perspective view of the sliding support member of the structural support assembly of FIG. 8.
Figure 11:
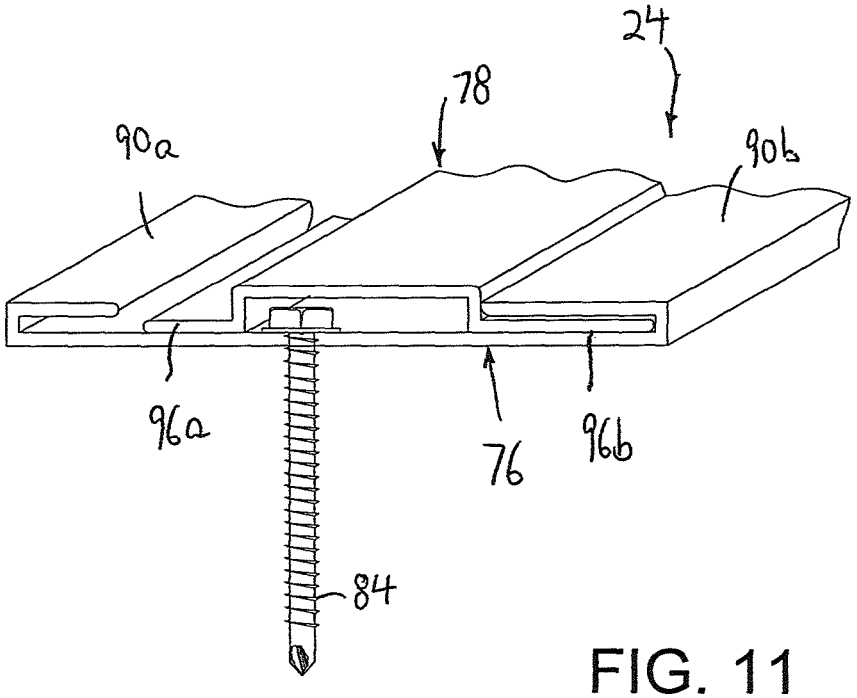
FIG. 11 is a perspective view of the structural support assembly of FIG. 8 in an initial assembly condition.

As shown in FIGS. 2, 4 and 6, each main fastening extrusion 20 is preferably formed as a single, one-piece, unitary member that includes a base section 26 that seats flush against and is secured to existing wall 14. Base section 26 has a plurality of linearly aligned openings 28 extending therealong and through which screws 30 are inserted to secure base section 26 to existing wall 14.

Two, parallel, spaced apart, bent end retaining walls 32 extend outwardly at right angles from base section 26 at a center thereof and are spaced from respective side edges 34 of base section 26. Preferably, each bent end retaining wall 32 extends about one-third of the distance from one side edge 34 to the opposite side edge 34, although the present invention is not limited thereby. Thus, bent end retaining walls 32 separate base section 26 into a first base plate section 26*a* to the outside of one retaining wall 32, a second base plate section 26*b* to the outside of the other retaining wall 32 and a third base plate section 26*c* between the two retaining walls 32, as shown in FIG. 6.

An enlarged holding section 36 extends along the upper end of each retaining wall 32. In this embodiment, enlarged holding section 36 has a triangular cross-sectional shape, so that each retaining wall 32 and its holding section 36 has the shape of an arrow in cross-section. However, the present invention is not limited to the triangular shape of holding sections 36, and any other suitable shape can be used. Thus, each holding section 36 includes a first wall surface 36*a* that extends at right angles to an outer side of the upper end of retaining wall 32 in parallel, spaced relation to first and second base plate sections 26*a*, 26*b*, a second wall surface 36*b* that extends at right angles to an inner side of the upper end of retaining wall 32 in parallel, spaced relation to third base plate section 26*c*, a first inclined wall surface 36*c* that extends upwardly at an angle from first wall surface 36*a* and a second inclined wall surface 36*d* that extends upwardly at an angle from second wall surface 36*b*, with inclined wall surfaces 36*c* and 36*d* meeting at an apex line 36*e*. A V-shaped notch 36*f* is formed centrally along each first inclined wall surface 36*c*.

Further, a side wall 38 extends outwardly at right angles along side edges 34 of base section 26. The height of side walls 38 is less than the height of retaining walls 32, the purpose for which will become apparent from the discussion hereafter.

Although retaining walls 32 and side walls 38 have been shown as continuous walls, a plurality of spaced apart and linearly aligned retaining walls 32 and side walls 38 can be provided instead, and in fact, a plurality of spaced apart main fastening extrusions 20 can also be used instead.

Figure 3:
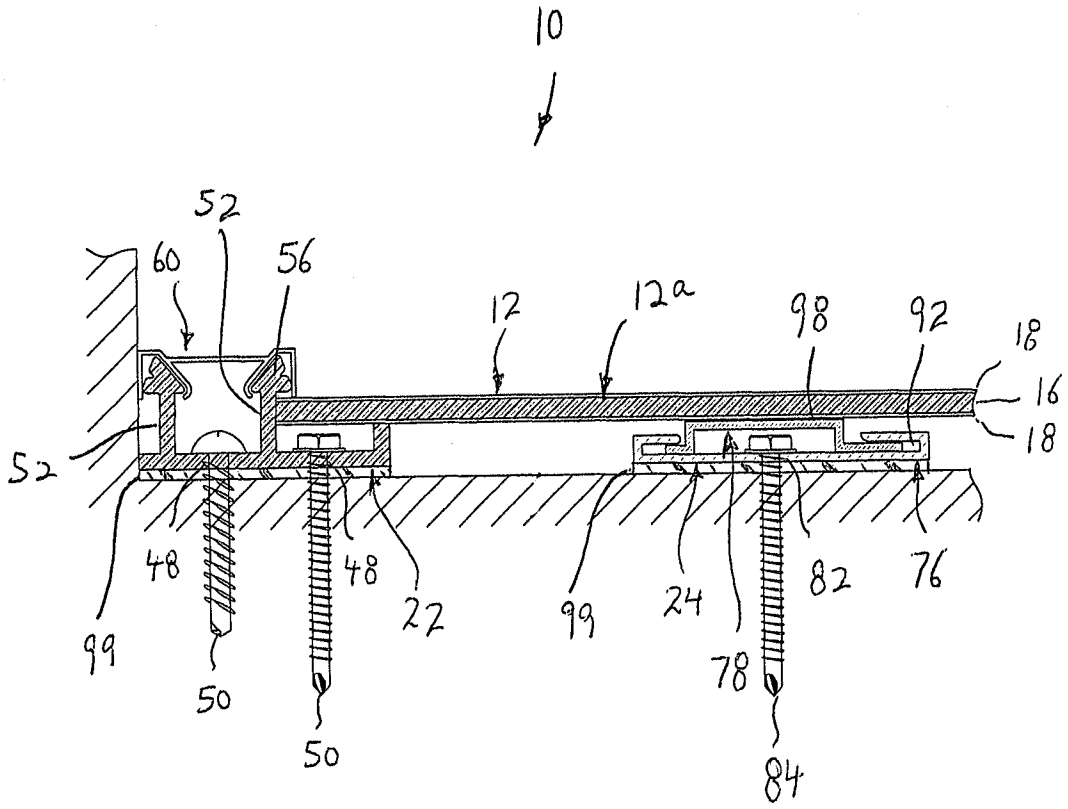
FIG. 3 is a cross-sectional view of the system of FIG. 1.
Figure 5:
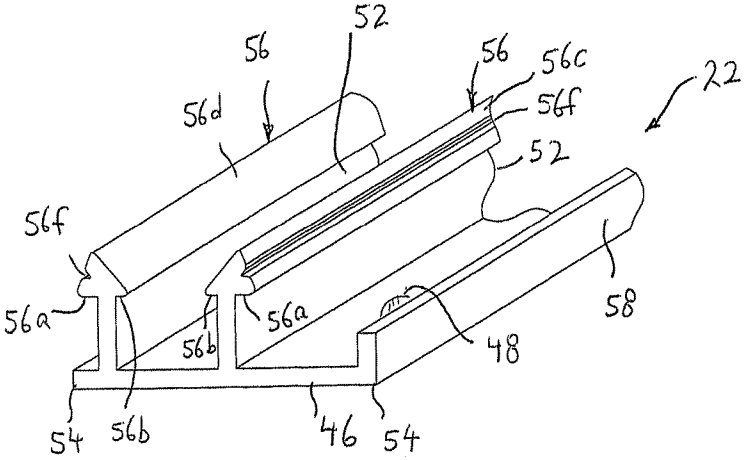
FIG. 5 is a perspective view of the corner fastening extrusion of FIG. 1.

As shown in FIGS. 1, 3 and 5, each corner fastening extrusion 22 is preferably formed as a single, one-piece, unitary member that includes a base section 46 that seats flush against and is secured to existing wall 14. Base section 46 has a plurality of linearly aligned openings 48 extending therealong and through which screws 50 are inserted to secure base section 46 to existing wall 14.

Two, parallel, spaced apart, bent end retaining walls 52 extend outwardly at right angles from base section 46 at a center thereof and are spaced from respective side edges 54 of base section 46. An enlarged holding section 56 extends along the upper end of each retaining wall 52. In this embodiment, enlarged holding section 56 has a triangular cross-sectional shape, so that each retaining wall 52 and its holding section 56 has the shape of an arrow in cross-section. However, the present invention is not limited to the triangular shape of holding sections 56, and any other suitable shape can be used. Thus, each holding section 56 includes a first wall surface 56*a* that extends at right angles to an outer side of the upper end of retaining wall 52 in parallel relation to base section 46, a second wall surface 56*b* that extends at right angles to an inner side of the upper end of retaining wall 52 in parallel relation to base section 46, a first inclined wall surface 56*c* that extends upwardly at an angle from first wall surface 56*a* and a second inclined wall surface 56*d* that extends upwardly at an angle from second wall surface 56*b*, with inclined wall surfaces 56*c* and 56*d* meeting at an apex line 56*e*. A V-shaped notch 56*f* is formed centrally along each first inclined wall surface 56*c*.

Further, a side wall 58 extends outwardly at right angles along only one side edge 54 of base section 26. The height of side wall 58 is less than the height of retaining walls 52, the purpose for which will become apparent from the discussion hereafter.

Although retaining walls 52 and side walls 58 have been shown as continuous walls, a plurality of spaced apart and linearly aligned retaining walls 52 and side walls 58 can be provided instead, and in fact, a plurality of spaced apart corner fastening extrusions 22 can also be used instead.

As shown in FIGS. 1-4 and 7, a closure member 60 is provided to clamp onto enlarged holding sections 36 and 56. Closure member 60 can be made of any suitable thin material such as aluminum. Specifically, closure member 60 includes first and second clamping members 62 and 64 connected together in parallel, spaced apart relation by a connecting plate 65. Each clamping member 62 and 64 includes a sitting wall 66 that sits on top of apex line 36*e*, 56*e* in parallel relation to base section 26, 46, an outer covering wall 68 that extends adjacent to first inclined walls 36*c* and 56*c* at a right angle to sitting wall 66 and which extends down from the outer edge of sitting wall 66 to a position slightly below first walls 36*a* and 36*b*, and an inclined inner lock-down wall 70 that extends adjacent to second inclined walls 36*d* and 56*d* and which extends down from the inner edge of sitting wall 66 at the same angle as second inclined walls 36*d* and 56*d* so as to be positioned thereon. The free lower edge of inclined inner lock-down wall 70 includes a bent tab 72 that wraps to the underside of second walls 36*b* and 56*b* so as to clamp each clamping member 62 and 64 to a respective enlarged holding section 36, 56. Connecting plate 65 is arranged parallel to base section 26, 46 and connects together inclined inner lock-down walls 70 of closure members 60.

As shown in FIGS. 1-4 and 8-10, each structural support assembly 24 includes a base support 76 that is secured to existing wall 14 and a sliding support member 78 that is slidably retained within base support 76.

Base support 76 includes an elongated base plate 80 having openings 82 therein through which screws 84 extend to secure base plate 80 to existing wall 14, and L-shaped retaining walls 86*a* and 86*b* that extend outwardly from opposite side edges of base plate 80. Specifically, each L-shaped retaining wall 86*a*, 86*b* includes a first wall 88*a*, 88*b* that extends at a right angle from a side edge of base plate 80 and an inwardly extending second wall 90*a*, 90*b* that extends toward the opposite side edge of base plate 80 in parallel spaced apart relation to base plate 80 with a space 92 therebetween, with free edges of second walls 90*a*, 90*b* spaced apart by a distance D. Preferably, inwardly extending second wall 90*b* has a greater width than inwardly extending second wall 90*a*.

Sliding support member 78 includes an inverted U-shaped plate 94 that fits in the space between the spaced-apart free edges of second walls 90*a*, 90*b*, and wing plates 96*a*, 96*b* at opposite free ends at the side edges of inverted U-shaped plate 94, with wing plates 96*a*, 96*b* slidably retained in spaces 92. Preferably, wing plate 96*b* has a greater width than wing plate 96*a*. It will be appreciated that the distance between free edges of wing plates 96*a*, 96*b* is less than the distance between first walls 88*a*, 88*b* of each L-shaped retaining wall 86*a*, 86*b* so as to permit side to side sliding of sliding support member 78 within base support 76.

It will be appreciated that, base section 26, base section 46 and/or base support 76 may be made of a metal material, and therefore, would be thermally conductive, that is, would undesirably transfer heat and cold from the outside to existing wall 14. Therefore, a thermal break insulation 99 can be positioned between existing wall 14 and base section 26, base section 46 and/or base support 76 so that base section 26, base section 46 and/or base support 76 are not in direct contact with existing wall 14 of the building, with screws 30, 50, 84 also inserted through the thermal insulation break 99. Any suitable thermally insulating material can be used, for example, ethylene propylene diene monomer (EPDM), neoprene, polyisoprene, natural rubber, synthetic rubber sold under the trademark VITON, nitrile rubber, silicone, plastics or the like.

Figure 12:
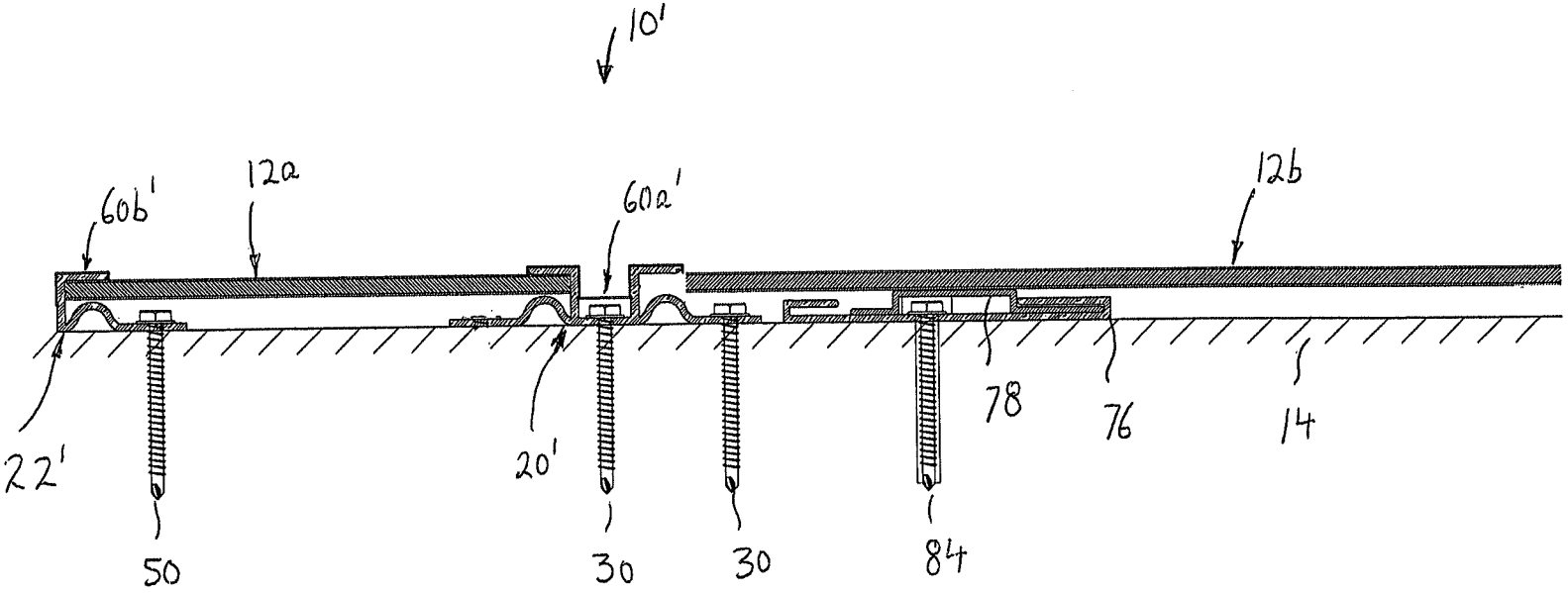
FIG. 12 is a cross-sectional view of a modification of the system for easily mounting wall panels over an existing wall, showing an initial condition for securement of first and second wall panels thereto.
Figure 13:
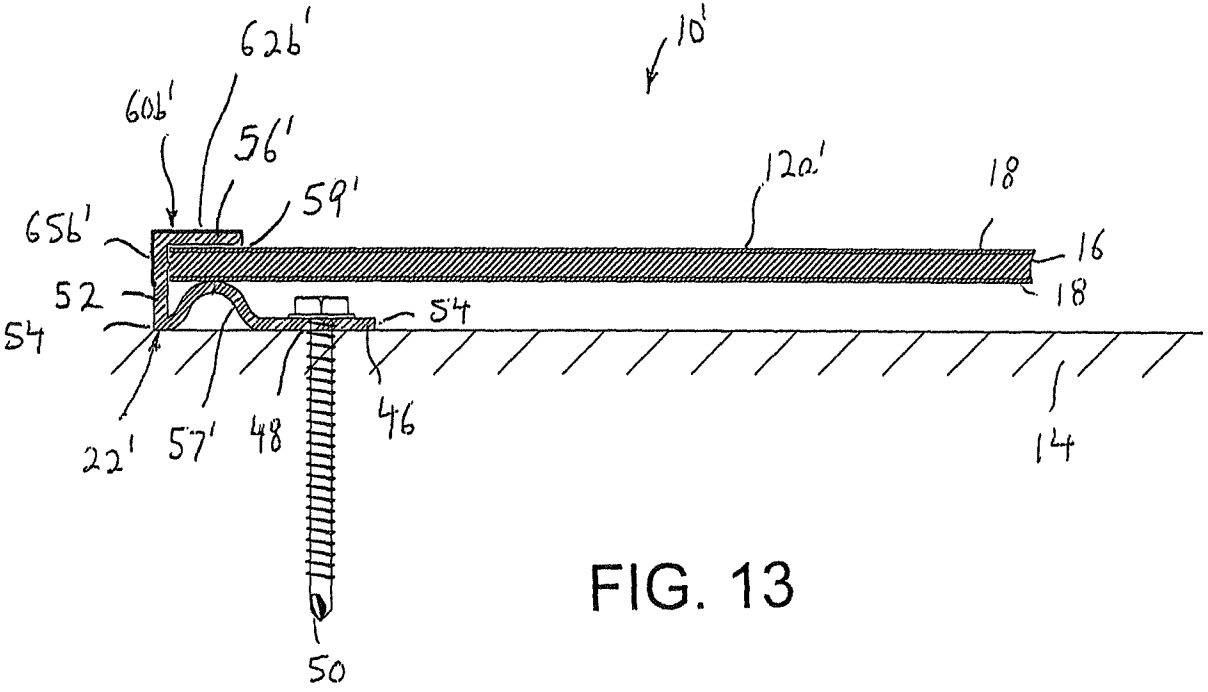
FIG. 13 is a cross-sectional view of the system of FIG. 12, showing securement of the first wall panel at a corner.
Figure 14:
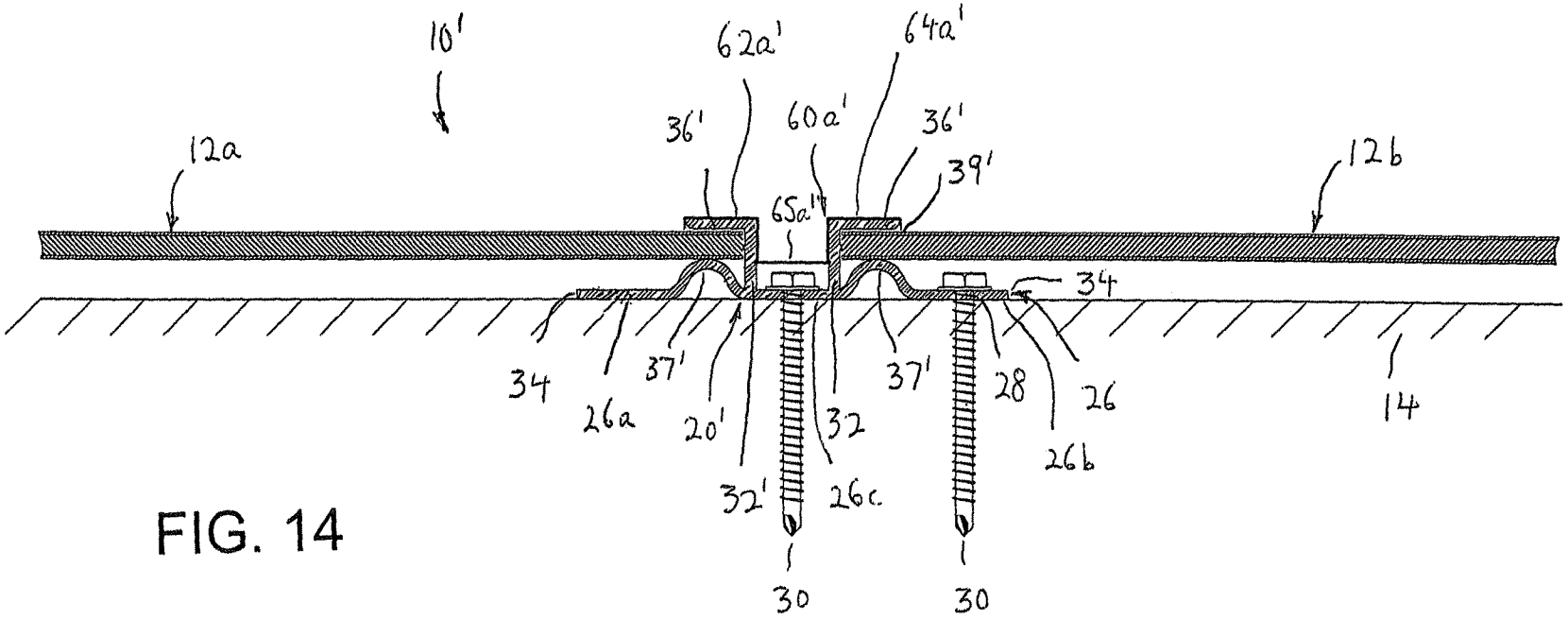
FIG. 14 is a cross-sectional view of the system of FIG. 12, showing securement of the second wall panel adjacent the first wall panel.
Figure 15:
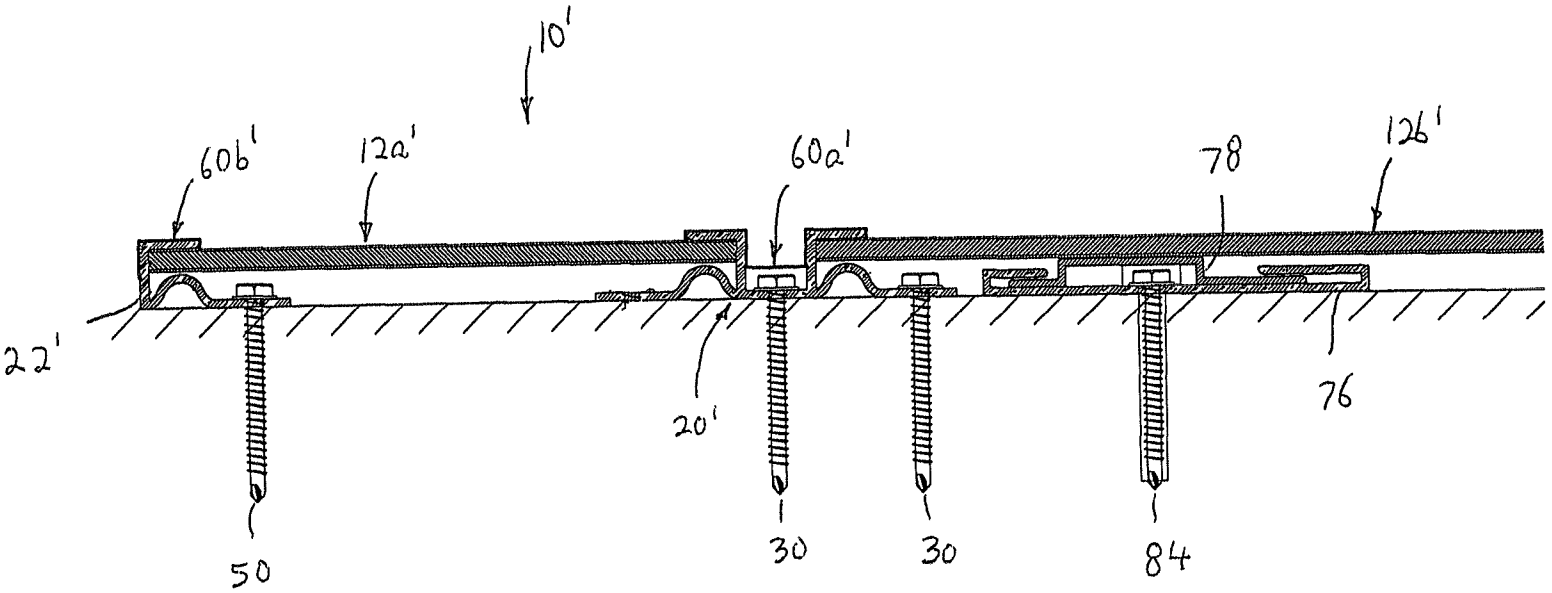
FIG. 15 is a cross-sectional view of the system of FIG. 12, showing a final assembled condition for securement of the first and second wall panels thereto.

Referring now to FIGS. 12-14, there is shown a system 10' which is a modification of the system 10 of FIGS. 1-11, and in which like elements are referred to by the same numerals, but in which modified elements are referred to by the same numerals with a prime (') added, and a detailed description of the like elements is not provided.

System 10' differs from system 10 only as to main fastening extrusions 20' and corner fastening extrusions 22'. All other elements are identical to those in system 10.

As shown in FIGS. 12 and 14, each main fastening extrusion 20' is preferably formed as a single, one-piece, unitary member that includes a base section 26 that seats flush against and is secured to existing wall 14. Base section 26 has a plurality of linearly aligned openings 28 extending therealong and through which screws 30 are inserted to secure base section 26 to existing wall 14.

Two, parallel, spaced apart, bent end retaining walls 32 extend outwardly at right angles from base section 26 at a center thereof and are spaced from respective side edges 34 of base section 26. Preferably, each bent end retaining wall 32 extends slightly more than about one-third of the distance from one side edge to the opposite side edge, although the present invention is not limited thereby. Thus, bent end retaining walls 32 separate base section 26 into a first base plate section 26*a* to the outside of one retaining wall 32, a second base plate section 26*b* to the outside of the other retaining wall 32 and a third base plate section 26*c* between the two retaining walls 32.

The enlarged holding sections 36 of main fastening extrusions 20 are eliminated, and in place thereof, a hold down wall 36' is connected at the upper end of each retaining wall 32'. Hold down wall 36' extends toward the respective outer side edge 34 and is provided in parallel, spaced relation with base section 26.

Also, side walls 38 of main fastening extrusions 20 are eliminated, and instead, first and second base plate sections 26*a* and 26*b* are each bent in an arcuate shape immediately adjacent the respective retaining wall 32 to form arcuate bends 37' that are bent in an arc towards the respective hold down wall 36', thereby creating a space 39' between the apex of each arcuate bend 37' and its respective hold down wall 36'.

Although retaining walls 32, hold down walls 36' and arcuate bends 37' have been shown as continuous walls, a plurality of spaced apart and linearly aligned retaining walls 32, hold down walls 36' and arcuate bends 37' can be provided instead.

A closure member 60*a'* is provided to clamp onto retaining walls 32 and hold down walls 36'. Closure member 60*a'* can be made of any suitable thin material such as aluminum. Specifically, closure member 60*a'* includes a U-shaped center section 65*a'* that fits snugly between retaining walls 32, and L-shaped cover walls 62*a'* and 64*a'* connected to the free edges of U-shaped center section 65*a'* and which seat on top of and wrap around the free edges of hold down walls 36'. As a result, the gap between retaining walls 32 is covered.

As shown in FIGS. 12 and 13, each corner fastening extrusion 22' is preferably formed as a single, one-piece, unitary member that includes a base section 46 that seats flush against and is secured to existing wall 14. Base section 46 has a plurality of linearly aligned openings 48 extending therealong and through which screws 50 are inserted to secure base section 46 to existing wall 14.

A single bent end retaining wall 52 extends outwardly at right angles from one side edge 54 of base section 46. The enlarged holding sections 56 of corner fastening extrusions 22 are eliminated, and in place thereof, a hold down wall 56' is connected at the upper end of each retaining wall 52. Hold down wall 56' extends toward the opposite side edge 54 and is provided in parallel, spaced relation with base section 46.

Also, side walls 58 of corner fastening extrusions 22 are eliminated, and instead, base section 46 is bent in an arcuate shape immediately adjacent retaining wall 52 to form an arcuate bend 57' that is bent in an arc towards hold down wall 56', thereby creating a space 59' between the apex of each arcuate bend 57' and hold down wall 56'.

Although retaining walls 52, hold down walls 56' and arcuate bends 57' have been shown as continuous walls, a plurality of spaced apart and linearly aligned retaining walls 52 hold down walls 56' and arcuate bends 57' can be provided instead.

A closure member 60*b'* is provided to clamp onto retaining wall 52 and hold down wall 56'. Closure member 60*b'* can be made of any suitable thin material such as aluminum. Specifically, closure member 60*b'* includes a first plate 65*b'* that seats against the outside of retaining wall 32 and an L-shaped cover wall 62*a'* connected to the outer free edge of first plate 65*b'* and which seats on top of and wraps around the free edge of hold down wall 36'.

Each structural support assembly 24 is of identical construction to that described in system 10, and therefore, a further explanation is omitted.

Assembly of wall panels 12 occurs in the same manner as described above in the embodiment of FIGS. 1-11.

As a result, wall panels 12 are securely and tightly held in place without any play between main fastening extrusions 20' and corner fastening extrusions 22'.

Figure 16:
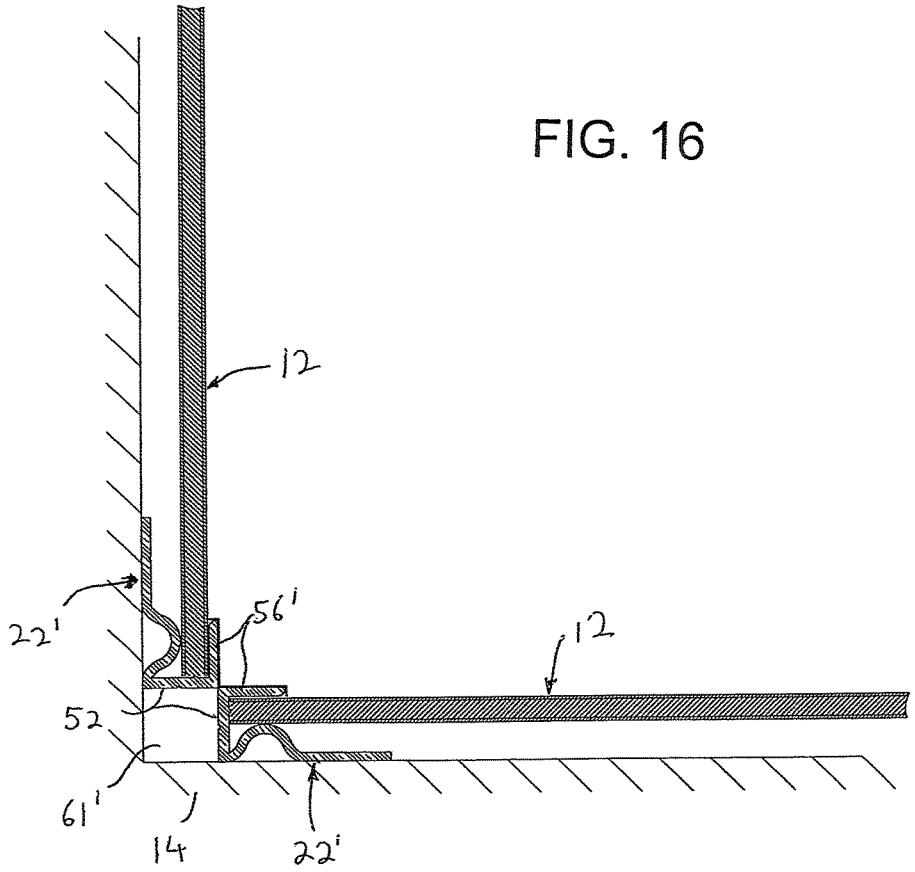
FIG. 16 is a cross-sectional view of a further modification of the system for easily mounting wall panels over an existing wall, showing the use of two corner fastening extrusions of the type shown in FIG. 13, at an inside corner of an existing wall.

Referring now to FIG. 16, there is shown a system for easily mounting wall panels over an existing wall, showing the use of two corner fastening extrusions 22' at an inside corner of existing wall 14. In this case, the corners of the two corner fastening extrusions 22' where each bent end retaining wall 52 meets its respective hold down wall 56' are in contact with each other. As a result, there is a rectangular parallelepiped space 61' between bent end retaining walls 52, which is shown to have a square transverse cross-sectional configuration. Screws 50 are omitted for the sake of clarity.

Figure 17:
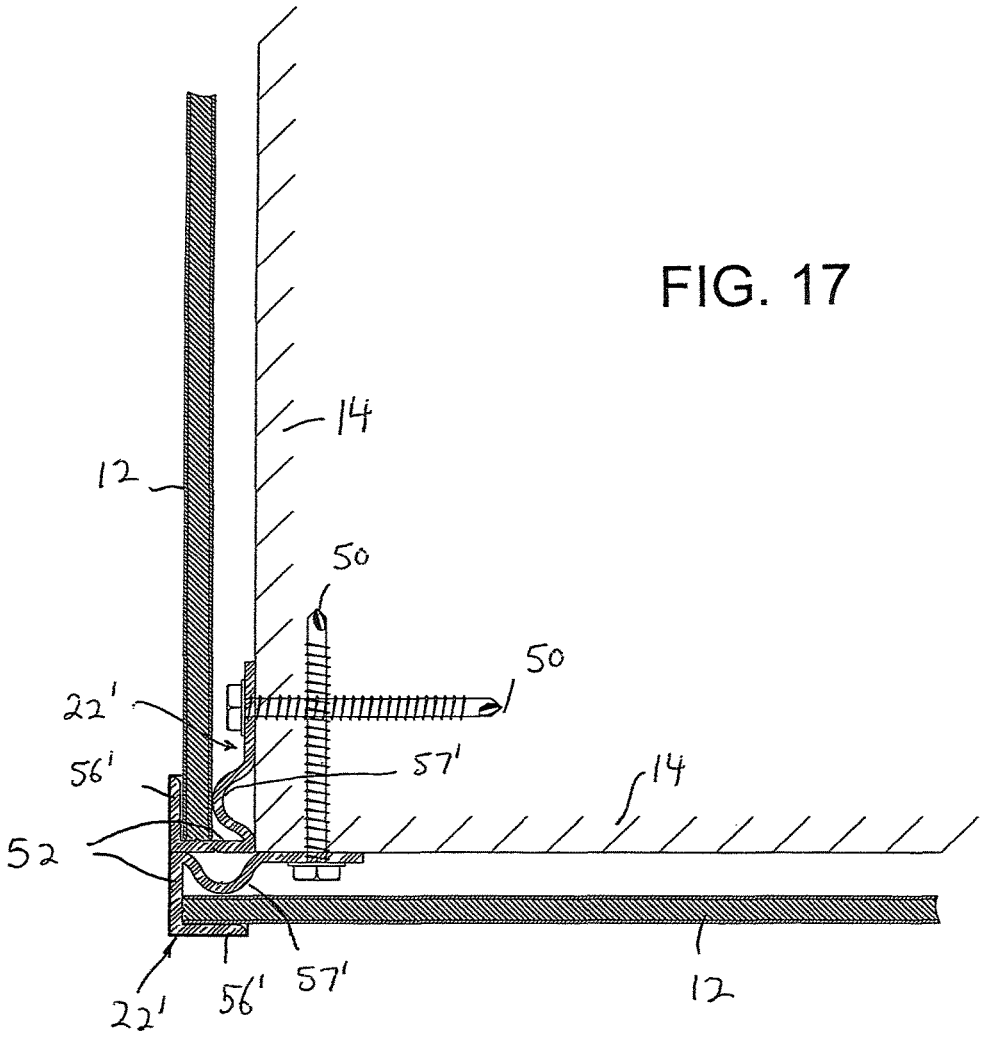
FIG. 17 is a cross-sectional view of a still further modification of the system for easily mounting wall panels over an existing wall, showing the use of two corner fastening extrusions of the type shown in FIG. 13, at an outside corner of an existing wall.

Referring now to FIG. 17, there is shown a system for easily mounting wall panels over an existing wall, showing the use of two corner fastening extrusions 22' at an outside corner of existing wall 14. In this case, arcuate bend 57' of one corner fastening extrusion 22' is in overlapping relation to bent end retaining wall 52 of the other corner fastening extrusion 22'.

Figure 18:
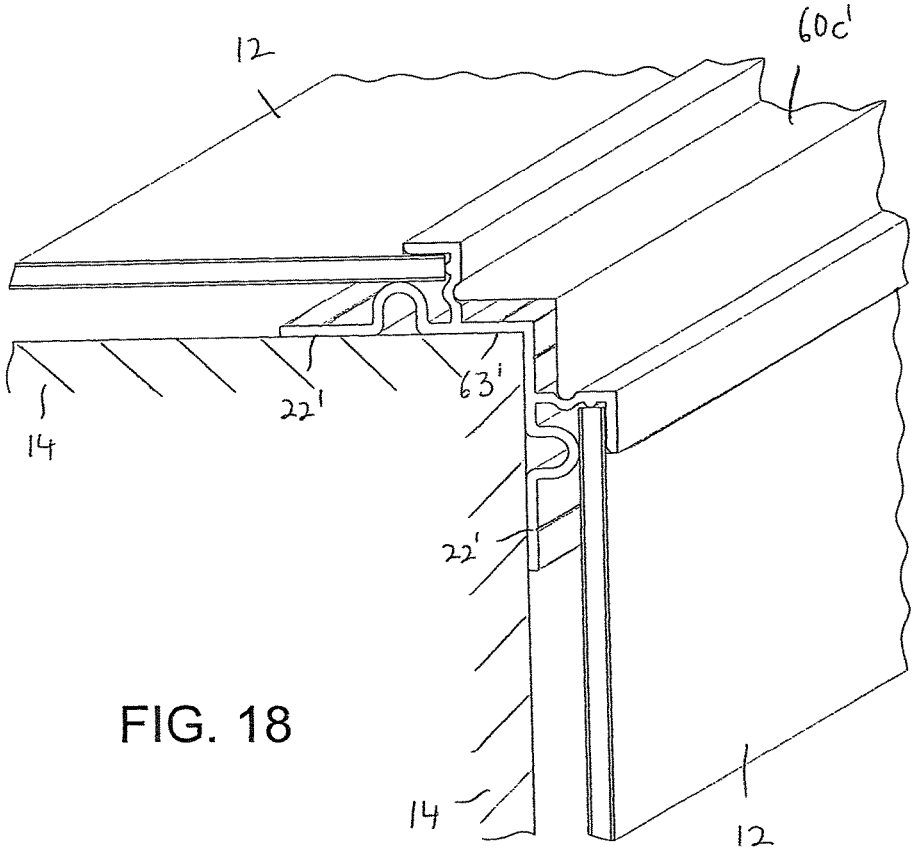
FIG. 18 is a cross-sectional view of a yet further modification of the system for easily mounting wall panels over an existing wall, showing the use of two corner fastening extrusions of the type shown in FIG. 13, at an outside corner of an existing wall.

Referring now to FIG. 18, there is shown a system for easily mounting wall panels over an existing wall, showing a modified construction for securement of the wall panels at an outside corner of existing wall 14. Specifically, two corner fastening extrusions 22' are connected together by an elongated L-shaped wall 63' that wraps around the corner of existing wall 14. Screws 50 are omitted for the sake of clarity, but can also be installed through L-shaped wall 63'. In such case, an elongated decorative cover 60*c'* is adhered on top of L-shaped wall 63' for decorative purposes.

Figure 18A:
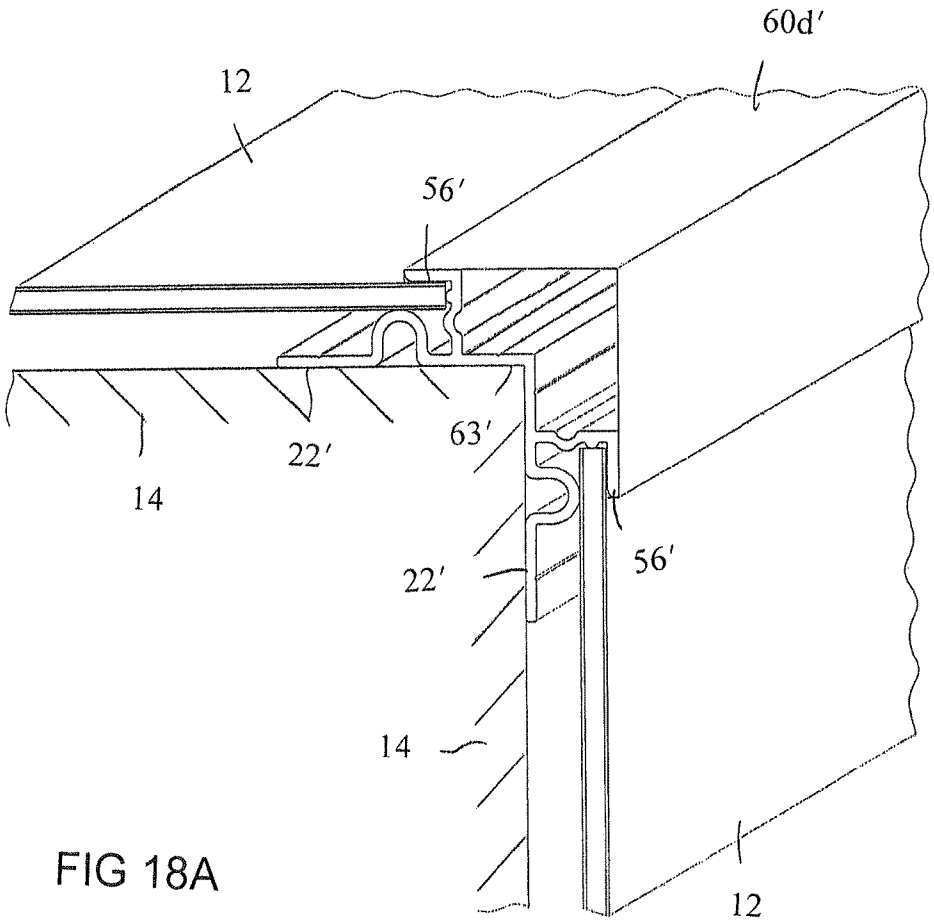
FIG. 18A is a cross-sectional view of the yet further modification of the system of FIG. 18, but with a different decorative cover.

FIG. 18A shows a modification of the system of FIG. 18, but with a different elongated decorative cover 60*d'* adhered on top of holding sections 56' for decorative purposes.

Of course, it will be appreciated that, in all of the embodiments of the present application, a thermal break insulation 99 can be positioned between existing wall 14 and base section 26, base section 46 and/or base support 76 so that base section 26, base section 46 and/or base support 76 are not in direct contact with existing wall 14 of the building.

Referring now to FIGS. 19-25, there is shown a system 10" which is a modification of the system 10' of FIGS. 12-18, and in which like elements are referred to by the same numerals, but in which modified elements are referred to by the same numerals with a double prime (") added, and a detailed description of the like elements is not provided.

System 10" differs from system 10' in two respects, and all other elements are identical to those in system 10' and therefore referred to by the same reference numerals.

Figure 19:
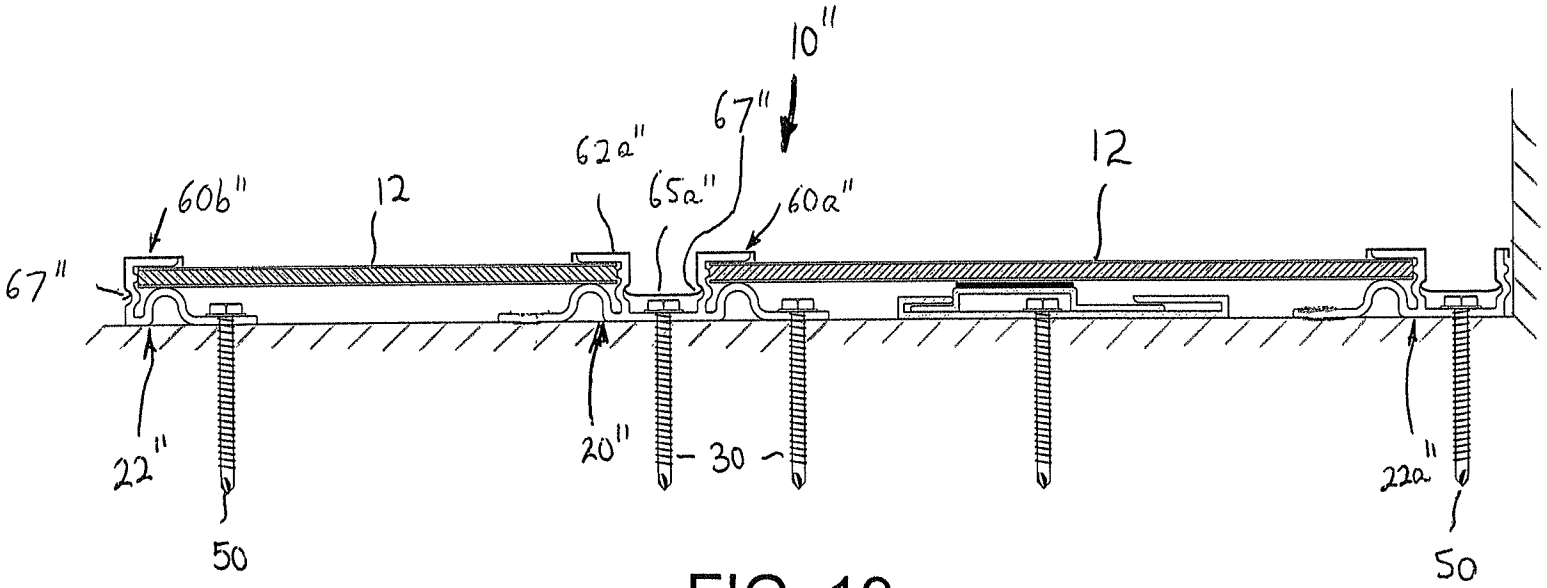
FIG. 19 is a cross-sectional view of a further modification of the system for easily mounting wall panels over an existing wall, showing a final assembled condition for securement of the first and second wall panels thereto.
Figures 20, 21, 22, 23, 24, 25:
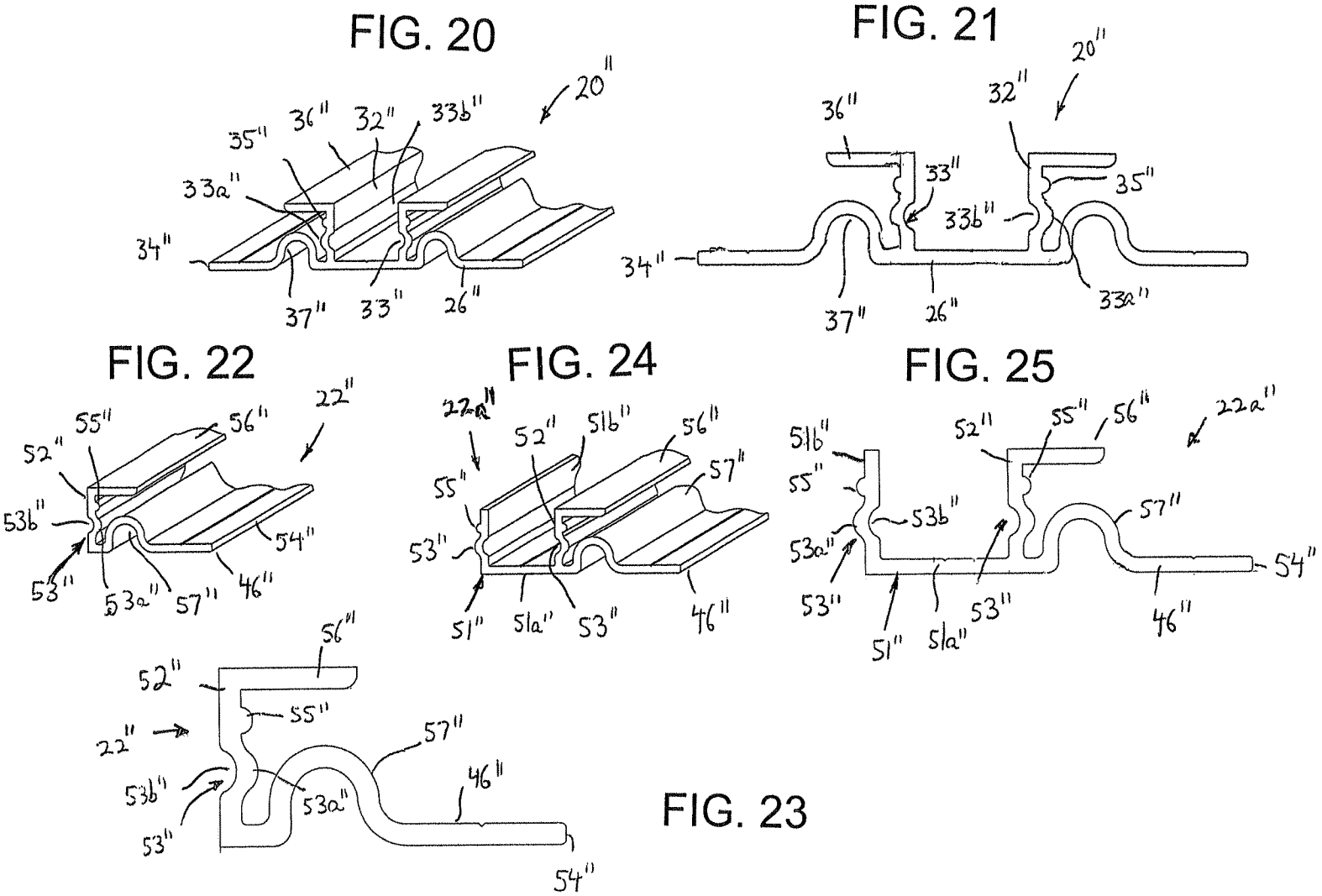
FIG. 20 is a perspective view of the main fastening extrusion of FIG. 19.
FIG. 21 is a cross-sectional view of the main fastening extrusion of FIG. 20.
FIG. 22 is a perspective view of the first corner fastening extrusion of FIG. 19.
FIG. 23 is a cross-sectional view of the corner fastening extrusion of FIG. 22.
FIG. 24 is a perspective view of the second corner fastening extrusion of FIG. 19.
FIG. 25 is a cross-sectional view of the corner fastening extrusion of FIG. 24.

Specifically, as shown in FIGS. 19-21, each retaining wall 32" of main fastening extrusions 20" is provided with a lower arcuate bend 33" that produces an outward bulge 33*a"* on the outwardly facing surface thereof and a recess 33*b"* on the inwardly facing surface thereof. Outward bulge 33*a"* is at the same height as the apex of the adjacent arcuate bend 37" formed in base section 26" in spaced relation from the respective side edge 34" of base section 26". This serves a twofold purpose. Specifically, outward bulge 33*a"* with the apex of arcuate bend 37" functions to support the lower surface of wall panel 12, and also, inward recess 33*b"* serves to receive and hold a lip 67" at the lower end of U-shaped center section 65*a"* of closure member 60*a"* to releasably lock closure member 60*a"* therein. L-shaped cover wall 62*a"* of closure member 60*a"* is the same as L-shaped cover wall 62*a'* of closure member 60*a'*.

In addition, each retaining wall 32" is provided with an upper bulge 35" on the outwardly facing surface thereof immediately above outward bulge 33*a"*, and against which the edge of wall panels 12 abut. The reason for such outward bulge 35" is as follows. When the temperature increases, the thin aluminum walls 18 of wall panel 12 expand at a greater rate than polyethylene core 16 thereof. As a result, thin aluminum walls 18 tend to expand in a direction toward retaining wall 32". However, if the outer surface of retaining wall 32" is planar, there is no room for expansion. By providing outward bulge 35", polyethylene core 16 abuts against outward bulge 35", but because of the sloping walls of outward bulge 35", aluminum walls 18 can expand in a direction past the outer edge of polyethylene core 16 in a direction toward the outer surface of retaining wall 32".

Of course, an enlarged holding section 36" extends along the upper end of each retaining wall 32", as described above.

In the same manner, the retaining wall 52" of each corner fastening extrusion 22" shown in FIGS. 19, 22 and 23, is provided with a lower arcuate bend 53" that produces an inward bulge 53*a"* on the inwardly facing surface thereof and a recess 53*b"* on the outwardly facing surface thereof, in a similar manner as arcuate bend 33", and an upper bulge 55" on the inwardly facing surface thereof immediately above outward bulge 53*a"*, in the same manner as upper bulge 35". Thus, outward bulge 53*a"* is at the same height as the apex of the adjacent arcuate bend 57" formed in base section 46" in spaced relation from the respective side edge 54" of base section 46". Of course, an enlarged holding section 56" extends along the upper end of each retaining wall 52", as described above. A closure member 60*b"* which is identical to closure member 60*a"* is provided, except that the lower end of closure member 60*b"* includes a lower lip 67" which is received and held in recess 53*b"*, as shown in FIG. 19.

In addition, as shown in FIGS. 19, 24 and 25, a modified corner fastening extrusion 22*a"* is shown at the closing end of existing wall 14. Corner fastening extrusion 22*a"* is identical to corner fastening extrusion 22" with the except that corner fastening extrusion 22*a"* further includes an L-shaped wall 51" extending to the outside of retaining wall 52", with one wall 51*a"* of L-shaped wall 51" continuing as an extension of base section 46" but on the opposite side of retaining wall 52" and secured to existing wall 14 by screws 50, and the other wall 51*b"* of L-shaped wall 51" extending from the free edge of wall 51*a*" and positioned against the adjacent side wall 14*a* of existing wall 14. Wall 51*b*" also includes a lower arcuate bend 53" that produces an outward bulge 53*a*" on the outwardly facing surface thereof and a recess 53*b*" on the inwardly facing surface thereof, in the same manner as arcuate bend 33", and an upper bulge 55" on the outwardly facing surface thereof immediately above outward bulge 53*a*", in the same manner as upper bulge 35". In this manner, a closure member is captured between retaining wall 52" and wall 51*b*" in the same manner as discussed above in relation to closure member 60*a*" and main fastening extrusion 20".

It will be appreciated that the aspects of system 10" of lower arcuate bend 53" with outward bulge 53*a*" and recess 53*a*", along with upper bulge 55", can be used with the first embodiment of FIGS. 1-11 as well.

Figure 26:
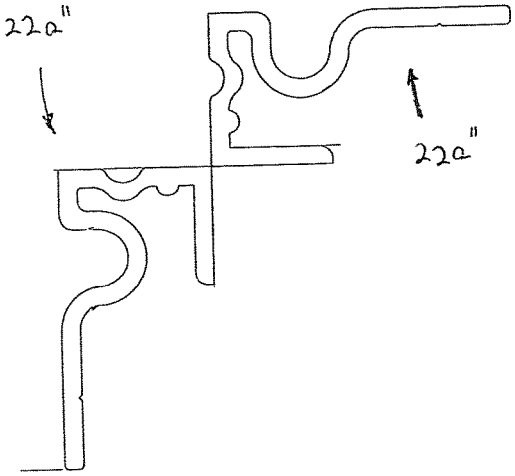
FIG. 26 is a cross-sectional view of a further modification of the system for easily mounting wall panels over an existing wall, showing the use of two connected together first corner fastening extrusions of the type shown in FIG. 22, for use at an inside corner of an existing wall in the same manner as shown in FIG. 16.
Figure 27:
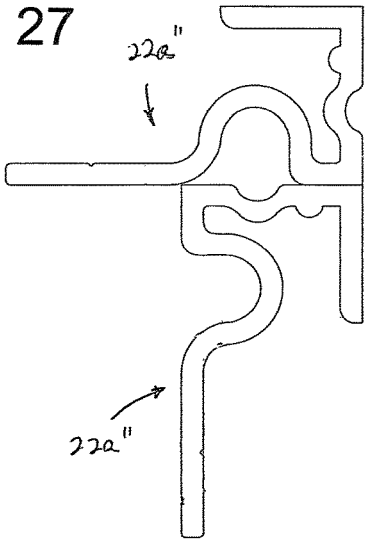
FIG. 27 is a cross-sectional view of a still further modification of the system for easily mounting wall panels over an existing wall, showing the use of two first corner fastening extrusions of the type shown in FIG. 22, for use at an outside corner of an existing wall in the same manner as shown in FIG. 17.
Figure 28:
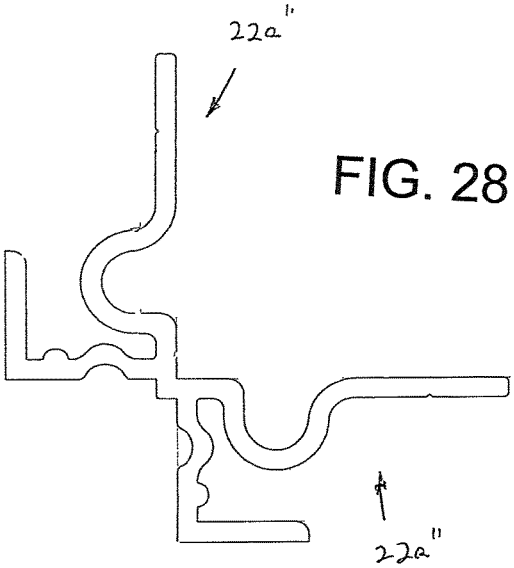
FIG. 28 is a cross-sectional view of a yet further modification of the system for easily mounting wall panels over an existing wall, showing the use of two first corner fastening extrusions of the type shown in FIG. 22, for use at an outside corner of an existing wall in the same manner as shown in FIG. 18.

FIG. 26 is a cross-sectional view of a further modification of the system for easily mounting wall panels over an existing wall, showing the use of two connected together first corner fastening extrusions 20*a*" of the type shown in FIG. 22, for use at an inside corner of an existing wall in the same manner as shown in FIG. 16;

FIG. 27 is a cross-sectional view of a still further modification of the system for easily mounting wall panels over an existing wall, showing the use of two first corner fastening extrusions 20*a*" of the type shown in FIG. 22, for use at an outside corner of an existing wall in the same manner as shown in FIG. 17;

FIG. 28 is a cross-sectional view of a yet further modification of the system for easily mounting wall panels over an existing wall, showing the use of two first corner fastening extrusions 20*a*" of the type shown in FIG. 22, for use at an outside corner of an existing wall in the same manner as shown in FIG. 18.

It will be appreciated that although only shown in the first embodiment of FIGS. 1-4, in all of the above embodiments, prior to securing a main fastening extrusion 20, 20' or 20", a corner fastening extrusion 22, 22', 22" or 22*a*" or base support 78 of structural support assembly 24 to existing wall 14, a thermal break insulation 99 is inserted over existing wall 14, and then main fastening extrusion 20, 20' or 20", a corner fastening extrusion 22, 22', 22" or 22*a*" or base support 78 of structural support assembly 24 is positioned over the thermal insulation break 99, with screws 30, 50, 84 also inserted through the thermal insulation break 99.

When installing wall panels over an existing wall, it is often necessary to provide a spacing between the wall panels and the existing wall. This spacing can be provided for ventilation, to provide for water run-off, to provide insulation therein, and to provide a thermal barrier. Typically, Z-furring or U-channel furring is used to provide this spacing between the existing wall and the wall panels. However, it has been found that this arrangement is not entirely satisfactory. For example, although it is known to combine insulation with the Z-furring or U-channel furring, such insulation is not securely held therein, and must be secured by screws, adhesive or the like. Further, the outwardly extending foot walls of the Z-furring or U-channel furring are secured directly to the existing wall, thereby providing thermal transfer directly with the existing wall. In addition, such Z-furring or U-channel furring may not be entirely satisfactory in providing thermal insulation, and in many cases, it is desirable to increase the thermal insulation. It is also not possible to change the spacing between the walls panels and existing wall since the Z-furring or U-channel furring are of fixed dimensions.

U.S. patent application Ser. No. 15/047,024, filed Feb. 18, 2016 and entitled THERMAL BREAK SYSTEM FOR WALL PANELS SECURED TO AN EXISTING WALL, the entire disclosure of which is incorporated herein by reference, to the same applicant herein, attempts to solve this problem by providing additional thermal insulation between the existing wall and the outside in a system utilizing Z-furring, U-channel furring, and T-furring.

The aforementioned sliding arrangement can be used in such a system utilizing Z-furring, U-channel furring, and T-furring.

Figure 29:
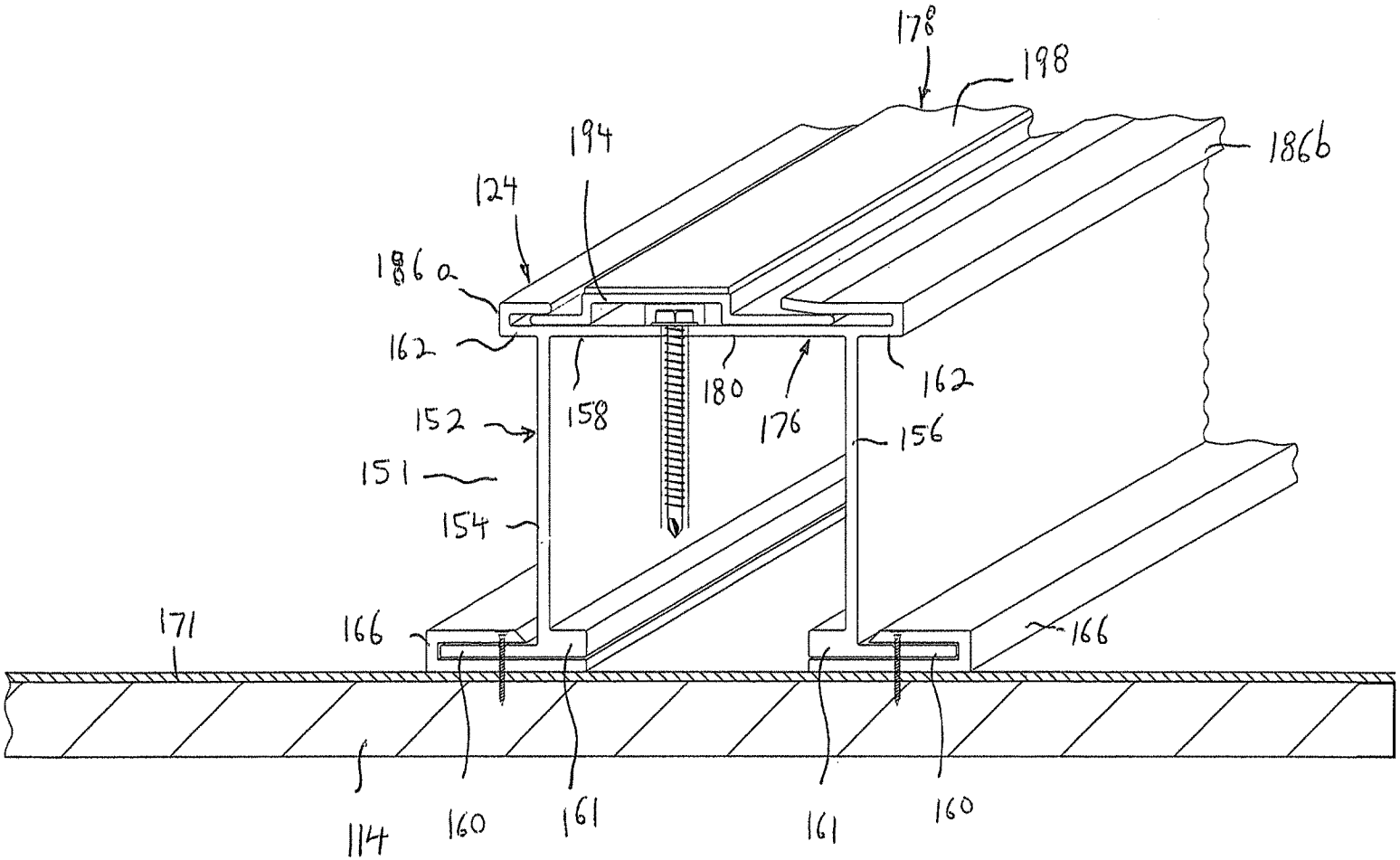
FIG. 29 is a perspective view of another embodiment of the system for easily mounting wall panels over an existing wall, using a U-channel furring with an intermediary structural support assembly.

Specifically, as shown in FIG. 29, in order to provide a spacing 151 between the wall panels (not shown) and the existing wall 114, for example, for ventilation, to provide for water run-off, to provide insulation therein, and to provide a thermal barrier, a U-channel furring 152 is connected between existing wall 114 and the wall panels.

Specifically, U-channel furring 152 includes two parallel, spaced apart spacing walls 154 and 156 connected together by a common transverse connection wall 158 at one end of walls 154 and 156, as is known. Also, outwardly extending foot walls 160 are connected to the opposite free ends of spaced apart walls 154 and 156, as is also known. However, in accordance with one aspect of said U.S. patent application Ser. No. 15/047,024, opposing inwardly extending foot walls 161 extend inwardly of walls 154 and 156 in a coplanar arrangement with outwardly extending foot walls 160, and opposite extension walls 162 are formed as a continuation of common transverse wall 158 and extend outwardly of spaced apart walls 154 and 156. In this manner, insulation (not shown) can be positioned in spacing 151 so as to be tightly held between foot walls 160 and extension walls 162 so as to prevent escape thereof, and to keep the insulation properly positioned at all times. Further, the insulation is tightly held between common transverse wall 158 and inwardly extending foot walls 161. This eliminates the need for any additional members to hold the insulation in place, such as screws, adhesives, etc., while also eliminating any extra labor that would result therefrom.

U-channel furring 152 is made of a metal material, and therefore, is thermally conductive, that is, will transfer heat and cold from the outside to existing wall 114, which is undesirable. Therefore, a generally J-shaped thermal insulation cover 166 is positioned around each foot wall 160, and is made of a thermally insulating material so that foot walls 160 are not in direct contact with existing wall 114 of the building. Any suitable thermally insulating material can be used, for example, ethylene propylene diene monomer (EPDM), neoprene, polyisoprene, natural rubber, synthetic rubber sold under the trademark VITON, nitrile rubber, silicone, plastics or the like.

As a result of the above arrangement, a space is further provided between the insulation and existing wall 114, which allows for water and air circulation. In this regard, a thin waterproof membrane 171 can be provided against existing wall 114.

With the above arrangement, elongated base plate 180 of base support 176 of each intermediary structural support assembly 124 is formed by common transverse connection wall 158 and opposite extension walls 162 of U-channel furring 152, with L-shaped retaining walls 186*a*, 186*b* extending outwardly from side edges of opposite extension walls 162. Further, in order to enhance easy insertion of sliding support member 178 therein, the free end of L-shaped retaining wall 186*b* is angled outwardly. FIG. 29 also shows an adhesive member 198, which can be a double sided tape, an adhesive or any other securing means, secured on top of inverted U-shaped plate 194 of sliding support member 178, for securement of a wall panel thereon.

Of course, it will be appreciated that, with the arrangement of FIG. 29, a similar U-channel furring 152 will be provided below each corner fastening extrusion and main fastening extrusion with the base section thereof formed by common transverse connection wall 158 and L-shaped retaining walls 186*a*, 186*b* of U-channel furring 152.

Figure 30:
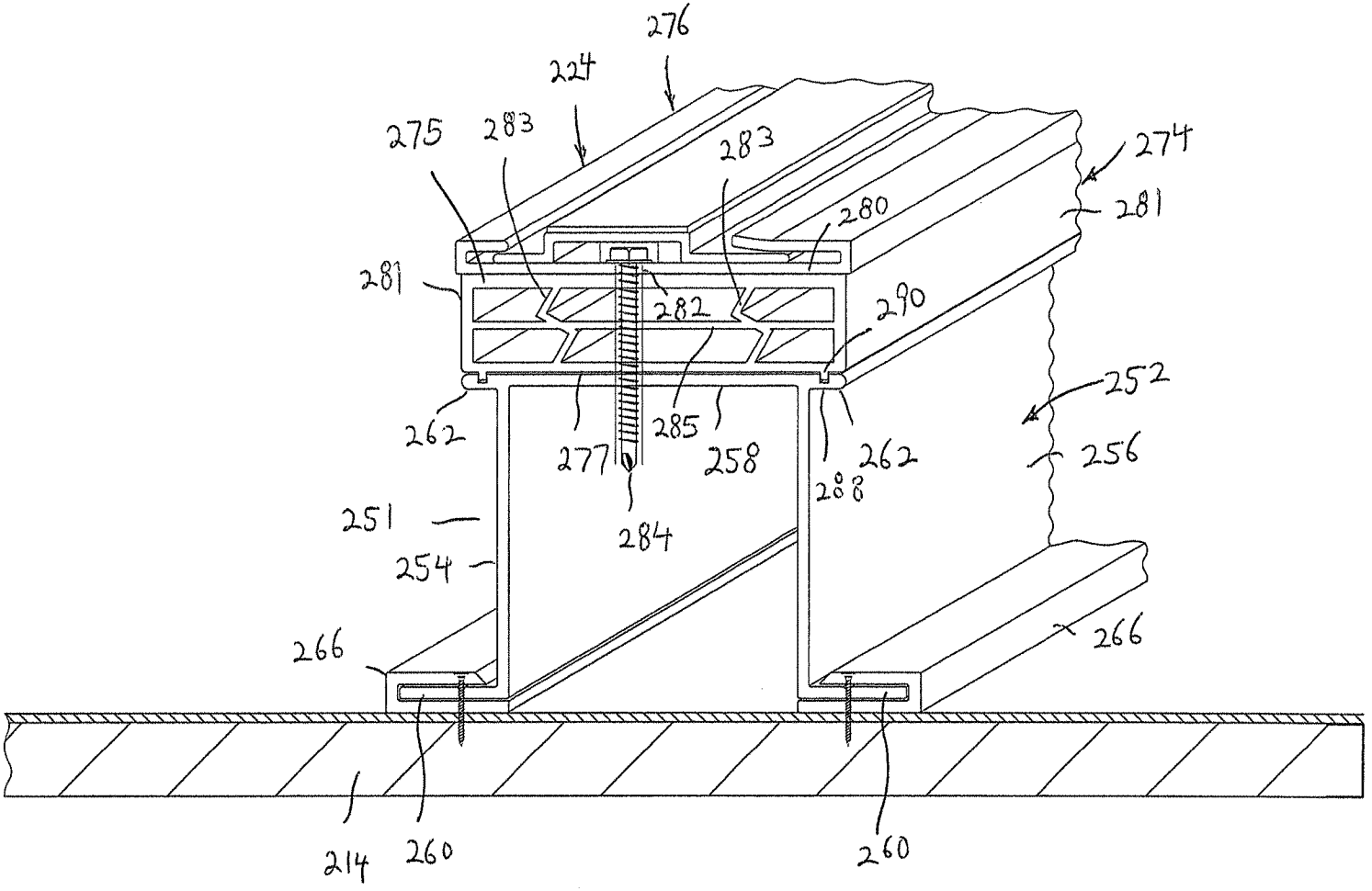
FIG. 30 is a perspective view of a modification of the embodiment of FIG. 29, using a U-channel furring with a thermal break attachment and an intermediary structural support assembly.

Referring now to FIG. 30, a further thermal break attachment 274 is connected between common transverse wall 258 of U-channel furring 252 and elongated base plate 280 of base support 276 of each intermediary structural support assembly 224.

U-channel furring 252 includes two parallel, spaced apart spacing walls 254 and 256 connected together by a common transverse connection wall 258 at one end of walls 254 and 256, as is known. Also, outwardly extending foot walls 260 are connected to the opposite free ends of spaced apart walls 254 and 256, as is also known. Opposing inwardly extending foot walls (not shown) can also be provided so as to extend inwardly of walls 254 and 256 in a coplanar arrangement with outwardly extending foot walls 260, and opposite extension walls 262 are formed as a continuation of common transverse wall 258 and extend outwardly of spaced apart walls 254 and 256. In this manner, insulation (not shown) can be positioned in spacing 251 so as to be tightly held between foot walls 260 and extension walls 262 so as to prevent escape thereof, and to keep the insulation properly positioned at all times. Further, the insulation is tightly held between common transverse wall 258 and the inwardly extending foot walls. This eliminates the need for any additional members to hold the insulation in place, such as screws, adhesives, etc., while also eliminating any extra labor that would result therefrom.

U-channel furring 252 is made of a metal material, and therefore, is thermally conductive, that is, will transfer heat and cold from the outside to existing wall 214, which is undesirable. Therefore, a generally J-shaped thermal insulation cover 266 is positioned around each foot wall 260, and is made of a thermally insulating material so that foot walls 260 are not in direct contact with existing wall 214 of the building. Any suitable thermally insulating material can be used, for example, ethylene propylene diene monomer (EPDM), neoprene, polyisoprene, natural rubber, synthetic rubber sold under the trademark VITON, nitrile rubber, silicone, plastics or the like.

Thermal break attachment 274 is formed by at least an outer wall 275 and a parallel, spaced apart inner wall 277 connected together by outer transverse walls 281 and preferably, also by inner transverse walls 283. As shown in FIG. 30, thermal break attachment 274 also includes an intermediate wall 285 in parallel spaced apart relation to and between outer wall 275 and inner wall 277, and also connected with transverse walls 281 and 283.

The upper surface of common transverse wall 258 of U-channel furring 252 includes parallel, spaced apart openings 288 having a dovetail cross-sectional configuration, and the lower surface of inner wall 277 of thermal break attachment 274 is provided with projections 290 having a dovetail cross-sectional configuration complementary in shape and dimensions to openings 288 to slidably lock therein.

Elongated base plate 280 of base support 276 of elongated intermediary structural support assembly 224 sits on top of outer wall 275 of thermal break attachment 274 and includes openings 282 therein through which screws 284 extend to secure base plate 280 to outer wall 275, inner wall 277 and intermediate wall 285.

Of course, it will be appreciated that, with the arrangement of FIG. 30, a similar U-channel furring 252 will be provided below each corner fastening extrusion and main fastening extrusion.

Figure 31:
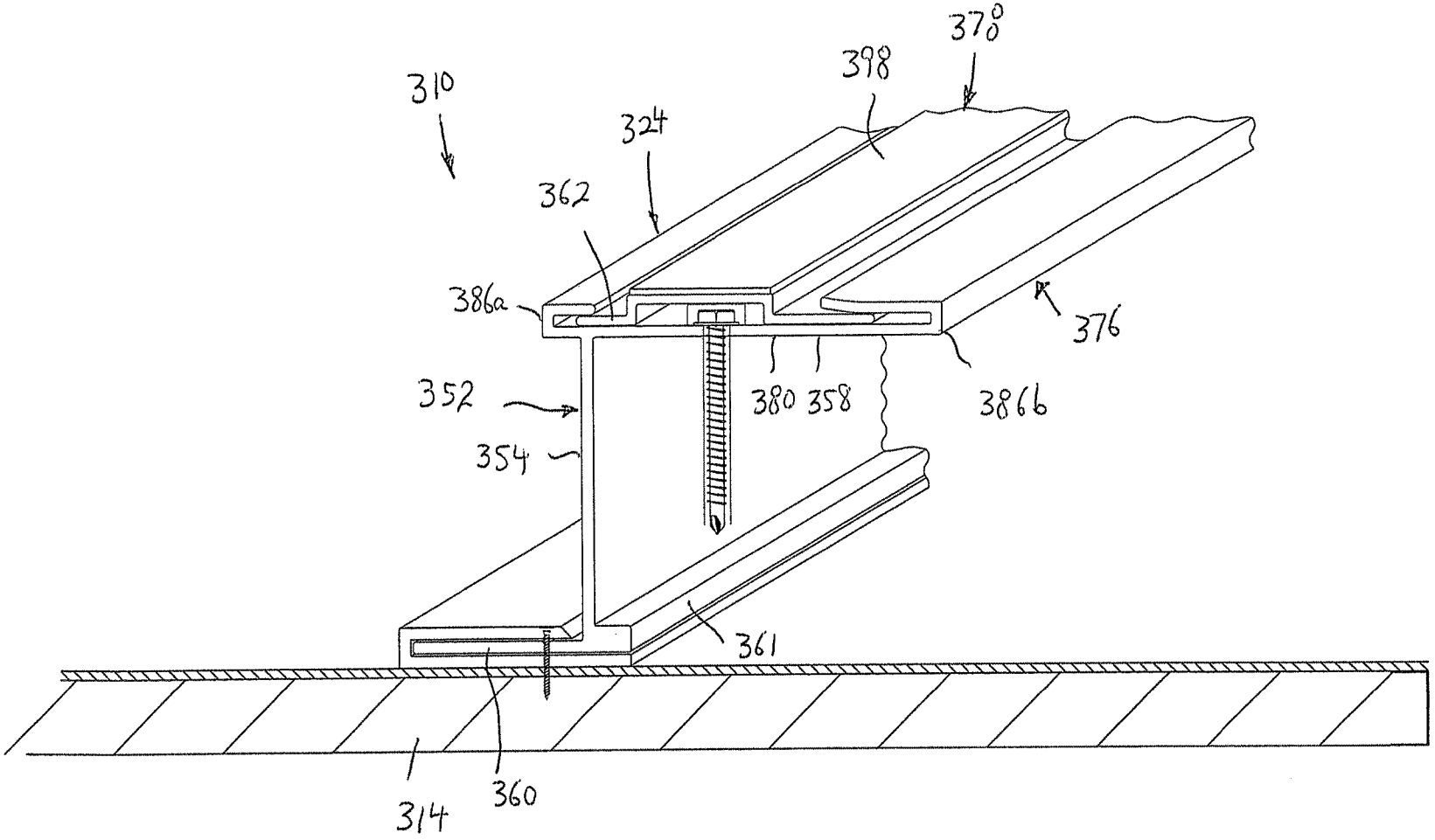
FIG. 31 is a perspective view of another modification of the embodiment of FIG. 29, using a Z-channel furring with an intermediary structural support assembly.

Referring now to FIG. 31, there is a shown a system 310 according to the present invention for mounting wall panels over an existing planar wall 314 through Z-furring 352 with thermal breaks. All of the elements shown in FIG. 31 are identical to those in FIG. 29 and use the same numerals augmented by a value of 200, except that U-channel furring 152 is replaced with Z-furring 352, and therefore, a detailed description of the common elements will be omitted for the sake of brevity.

Z-furring 352 includes a single spacing wall 354 that replaces the two parallel, spaced apart walls 154 and 156 of U-channel furring 152, with a transverse connection wall 358 at one end thereof and extending to the right side of wall 354 in FIG. 31, and an extension wall 362 formed as a continuation of transverse wall 358 and extending to the opposite left side of wall 354 in FIG. 31. An outwardly extending transverse foot wall 360 extends from the opposite end of wall 354 to the left side of wall 354 in FIG. 31, and a coplanar, inwardly extending transverse foot wall 361 is also connected to the opposite free end of wall 354, and extends to the right side of wall 354 in FIG. 31. In this manner, insulation is tightly held between foot wall 360 and extension wall 362 so as to prevent escape thereof, and to keep insulation properly positioned at all times. Further, insulation is tightly held between transverse wall 358 and inwardly extending foot wall 361. This eliminates the need for any additional members to hold the insulation in place, such as screws, adhesives, etc., while also eliminating any extra labor that would result therefrom.

As with U-channel furring 152, elongated base plate 380 of base support 376 of each intermediary structural support assembly 324 is formed by common transverse connection wall 358 and extension wall 362 of Z-channel furring 352, with L-shaped retaining walls 386*a*, 386*b* extending outwardly from side edges of opposite extension walls 362. Further, in order to enhance easy insertion of sliding support member 378 therein, the free end of L-shaped retaining wall 386*b* is angled outwardly. FIG. 31 also shows an adhesive member 398, which can be a double sided tape, an adhesive or any other securing means, secured on top of inverted U-shaped plate 394 of sliding support member 378, for securement of a wall panel thereon.

Of course, it will be appreciated that, with the arrangement of FIG. 31, a similar Z-channel furring 352 will be provided below each corner fastening extrusion and main fastening extrusion.

Further, a thermal break attachment similar to thermal break attachment 274 can be provided with this embodiment as well.

Figure 32:
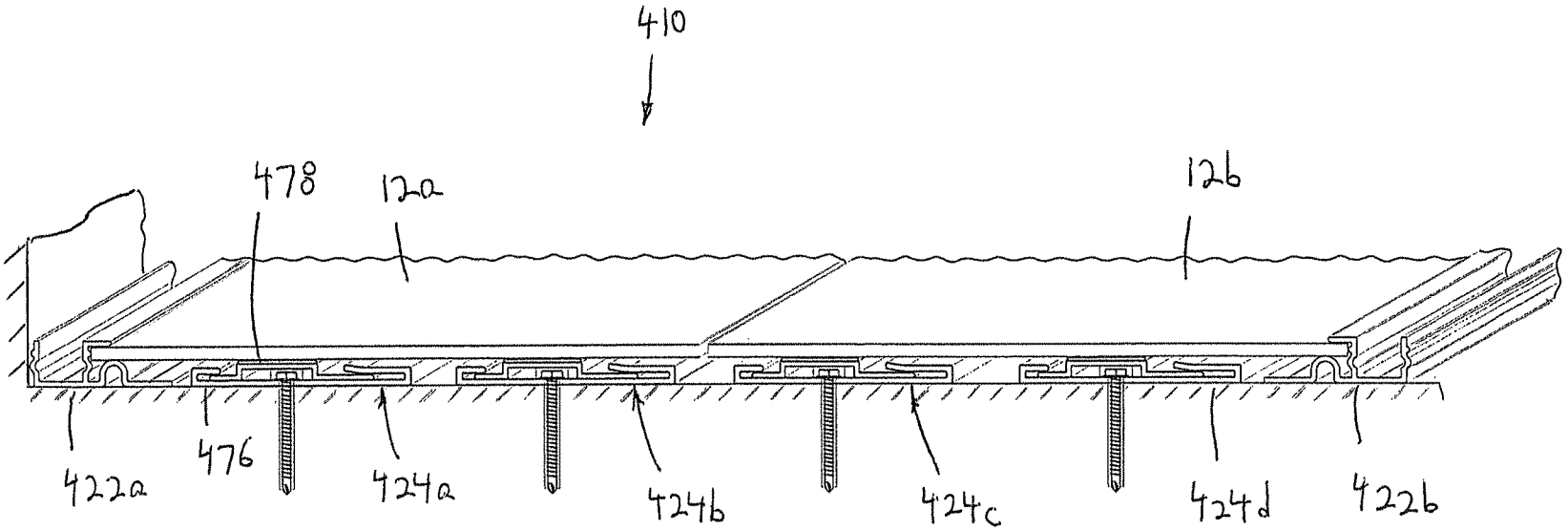
FIG. 32 is a perspective view of a further embodiment of the system for easily mounting wall panels over an existing wall without any main fastening extrusions, showing a final condition for securement of first and second wall panels thereto.

Referring now to FIG. 32, there is shown a further embodiment of a system 410 for easily mounting wall panels over an existing wall, showing a final condition for securement of first and second wall panels 12*a*, 12*b* thereto.

As shown therein, main fastening extrusions are eliminated, and there are only two panels 12*a*, 12*b* assembled without any main fastening extrusion therebetween. System 410 includes corner fastening extrusions 422 which are identical to corner fastening extrusions 22*a*" of FIGS. 24 and 25, and intermediary structural support assemblies 424 which are identical to intermediary structural support assemblies 224 of FIG. 30. With this arrangement, the leftmost corner fastening extrusion 422*a* is installed on existing wall 14, and base supports 476 of intermediary structural support assemblies 424*a* and 424*b* are then installed in spaced relation to leftmost corner fastening extrusion 422*a*. Then, sliding support members 478 are inserted into these base supports 476 to the extreme right thereof. Wall panel 12*a* is then connected to base supports 476 and slid to the left with base supports 476 to the position shown in FIG. 32.

Thereafter, base supports 476 of intermediary structural support assemblies 424*c* and 424*d* are then installed in spaced relation to wall panel 12*a*. Then, sliding support members 478 are inserted into base supports 476 of structural support assemblies 424*c* and 424*d* to the extreme right thereof. Wall panel 12*b* is then connected to base supports 476 and slid to the left with base supports 476 to the position shown in FIG. 32, with the left edge of wall panel 12*a* immediately adjacent the right edge of wall panel 12*a*. Thereafter, rightmost corner fastening extrusion 422*b* is installed on existing wall 14 with the right edge of wall panel 12*b*.

Further, system 410 can be used with many linearly aligned wall panels. For example, a further corner fastening extrusion (not shown) which is oriented the same as corner fastening extrusion 422*a* can be positioned adjacent the right side of corner fastening extrusion 422*b*, and two more wall panels can be assembled in the same manner, and so on. In such case, corner fastening extrusions 422 effectively become main fastening extrusions, and a cover can be provided to cover adjacent corner fastening extrusions 422.

Figure 33:
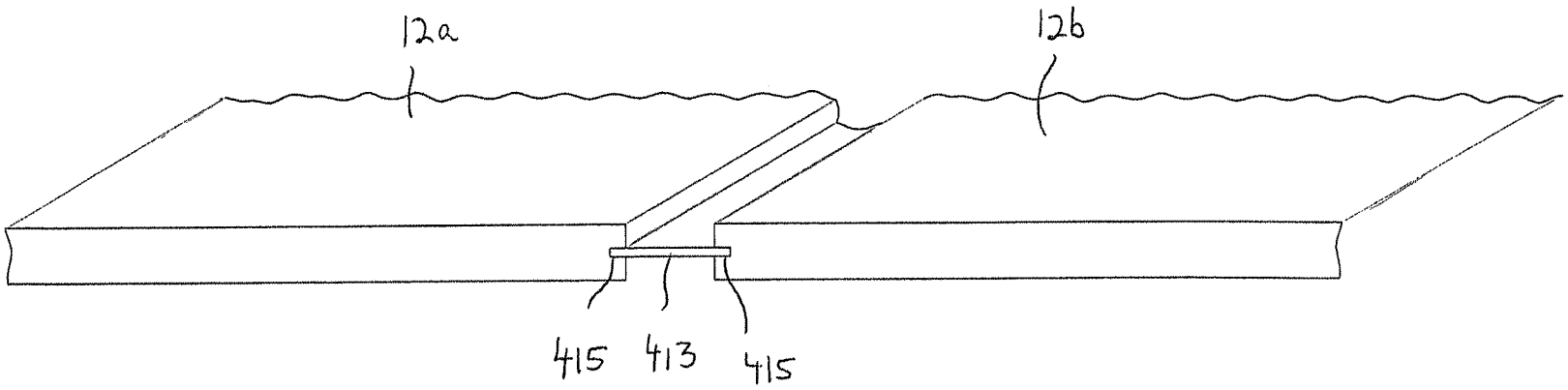
FIG. 33 is a perspective view of a connector arrangement for connecting together adjacent side edges of adjacent wall panels of FIG. 32.

Further, adjacent edges of adjacent walls panels 12*a* and 12*b* can be further connected together, as shown in FIG. 33, by a connecting plate 413 which fits within slots 415 of adjacent edges of wall panels 12*a* and 12*b*.

Figure 34:
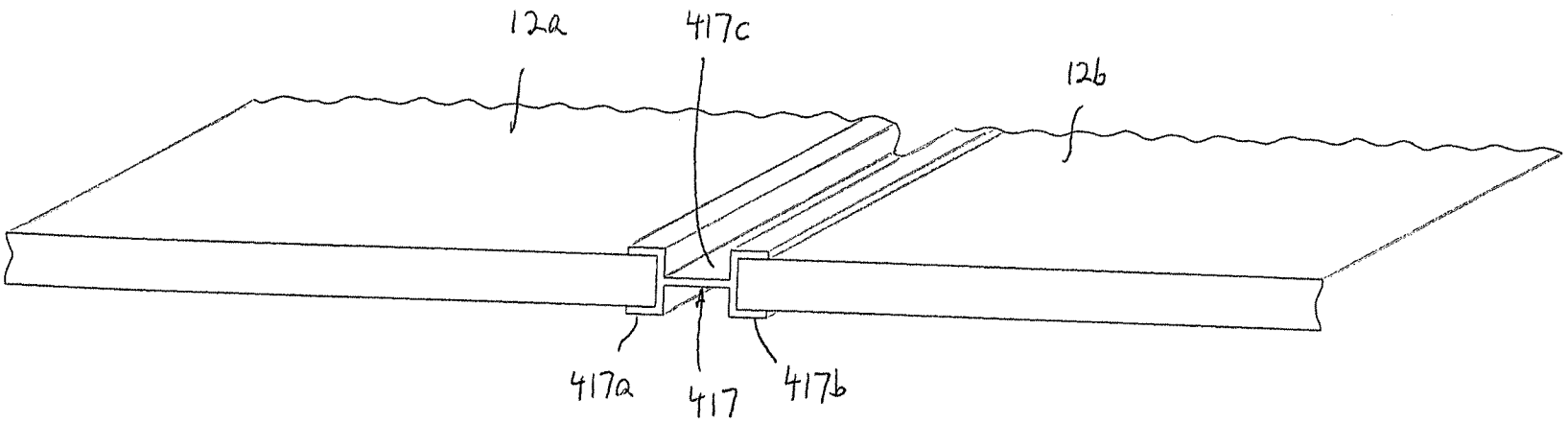
FIG. 34 is a perspective view of another connector arrangement for connecting together adjacent side edges of adjacent wall panels of FIG. 32.

Alternatively, as shown in FIG. 34, a connector 417 can be used to connect together adjacent edges of wall panels 12*a* and 12*b*. In such case, connector 417 includes a first U-shaped connector 417*a* that engages the side edge and top and bottom of wall panel 12*a*, a second U-shaped connector 417*b* that engages the side edge and top and bottom of wall panel 12*a*, and a connecting plate 417*c* that connects together first and second U-shaped connectors 417*a* and 417*b*.

Figure 32A:
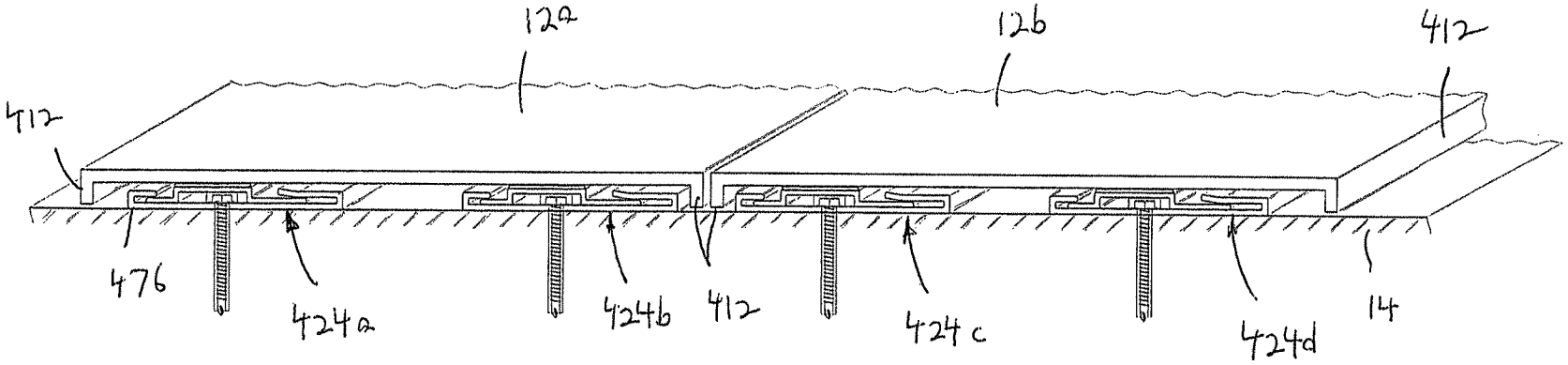
FIG. 32A is a perspective view of a modification of the further embodiment of FIG. 32.

As shown in FIG. 32A, inwardly turned bent end sections 412 can be provided at side and end edges of wall panels 12*a* and 12*b* so as to be in abutting relation to each other. This also eliminates the corner fastening extrusions.

Figure 35:
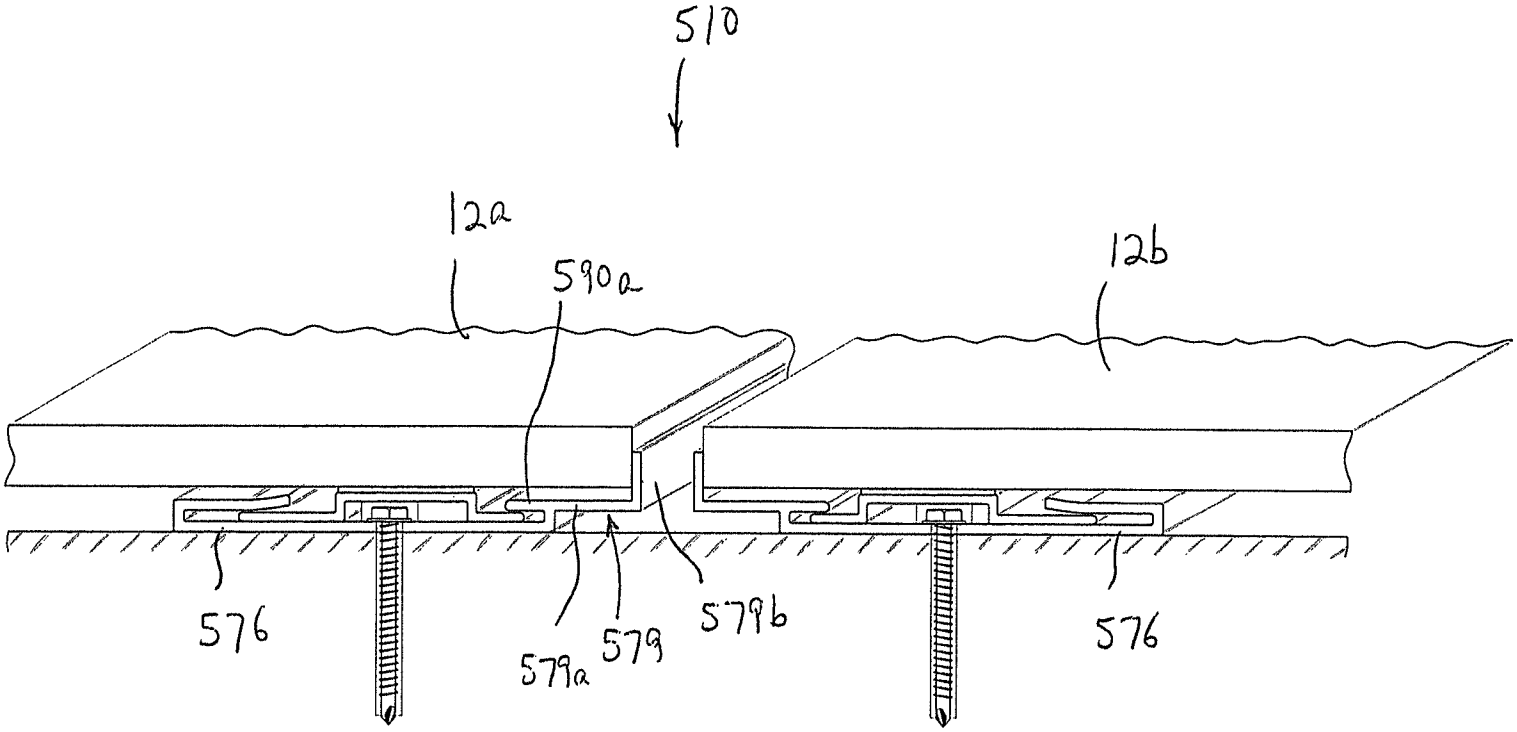
FIG. 35 is a perspective view of a still further embodiment of the system for easily mounting wall panels over an existing wall without any main fastening extrusions, showing a final condition for securement of first and second wall panels thereto.

Referring now to FIG. 35, there is shown a further embodiment of the system 510 for easily mounting wall panels over an existing wall, showing a final condition for securement of first and second wall panels 12*a*, 12*b* thereto.

In this embodiment, base supports 576 of intermediary structural support assemblies 524 for adjacent wall panels 12*a* and 12*b* are oriented 180 degrees out of phase with each other. Further, inwardly extending second wall 590*a* of each base support 576 includes an L-shaped extension wall 579 having a first wall 579*a* that is coplanar with and forms an outward extension of second wall 590*a* and a second wall 579*b* that extends at right angles outwardly from the free end of first wall 579*a* and which functions as a stop limit for the edge of the respective wall panel 12*a*, 12*b*.

Figure 36:
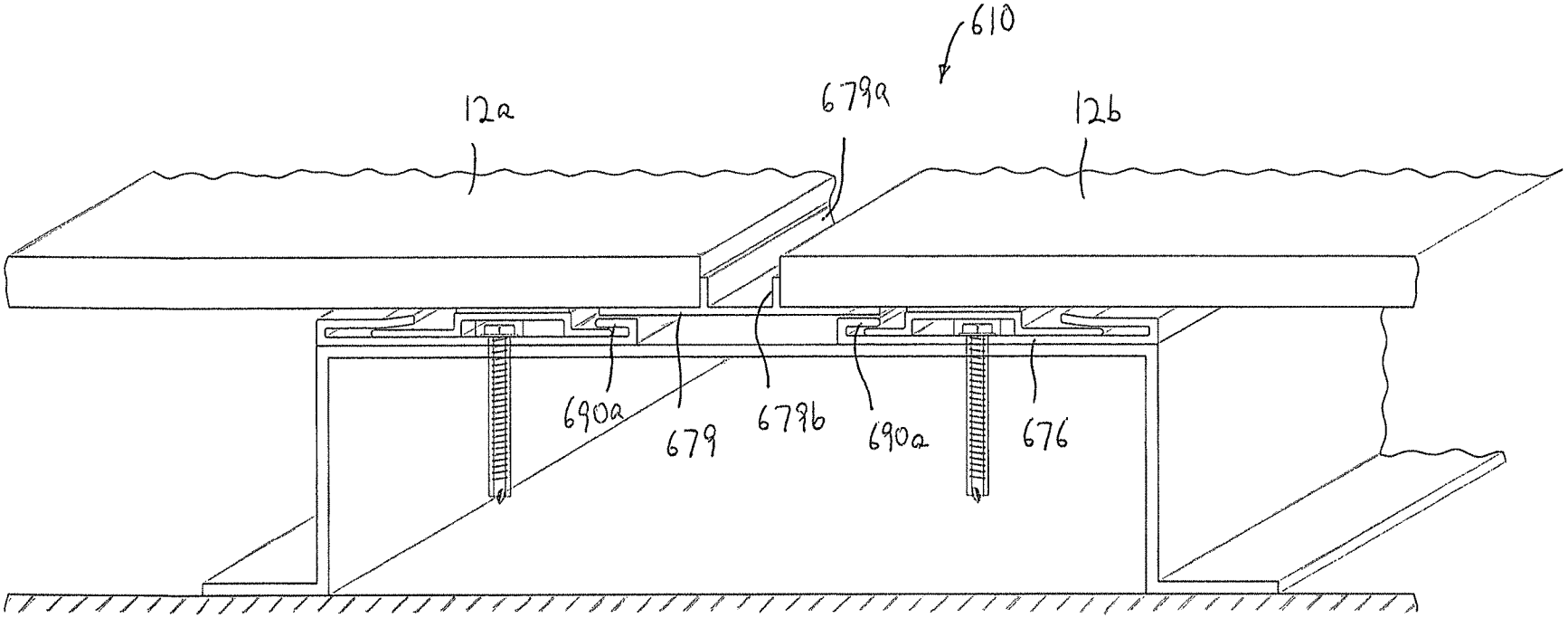
FIG. 36 is a perspective view of a yet further embodiment of the system for easily mounting wall panels over an existing wall without any main fastening extrusions, showing a final condition for securement of first and second wall panels thereto.

Alternatively, as shown in FIG. 36, in an alternative system 610, L-shaped extension walls 579 can be replaced with a common plate 679 that sits on top of adjacent second walls 690*a* of adjacent base supports 676 of intermediary structural support assemblies 624, and two parallel, spaced apart walls 679*a* and 679*b* extend outwardly from common plate 679 to function as stop limits for the edges of the respective wall panels 12*a*, 12*b*.

Figure 37:
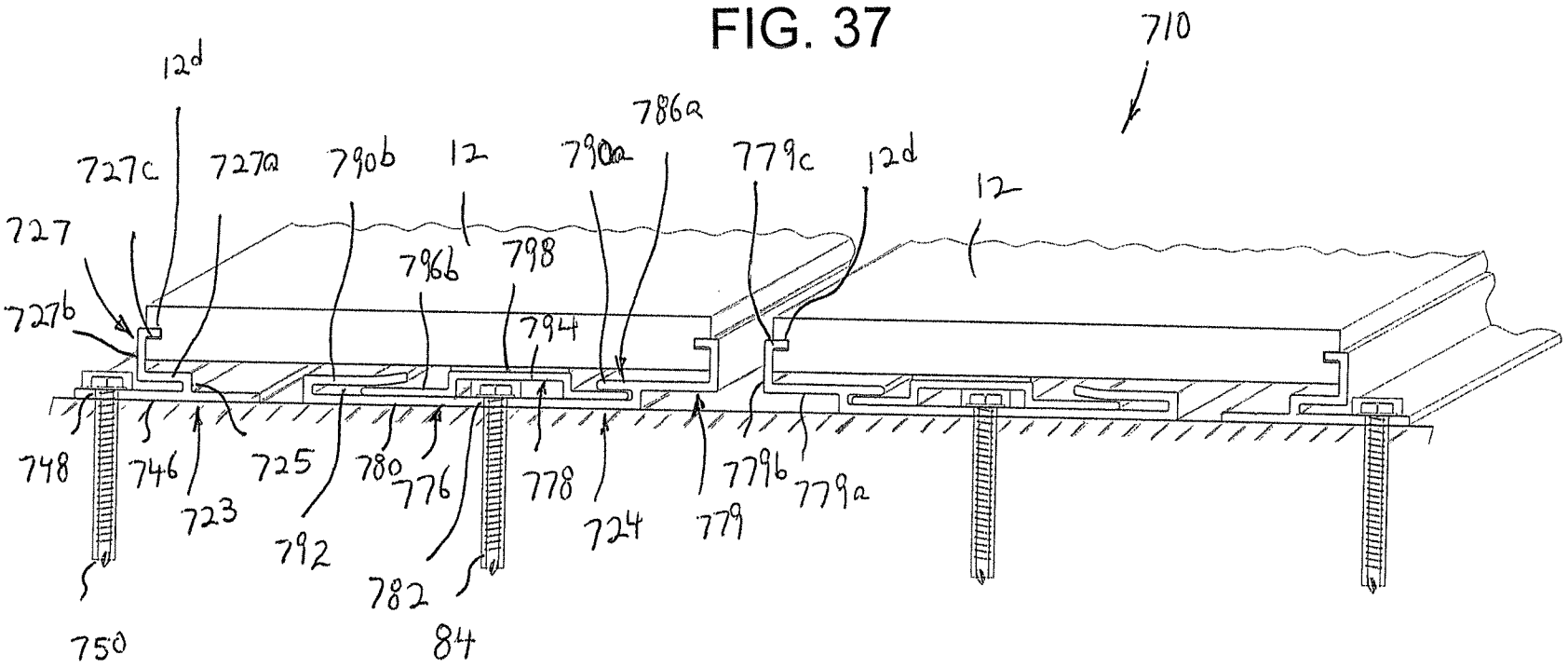
FIG. 37 is a perspective view of yet another embodiment of the system for easily mounting wall panels over an existing wall without any main fastening extrusions, showing a final condition for securement of first and second wall panels thereto.

A further alternative system 710 is shown in FIG. 37, in which each structural support assembly 724 includes a base support 776 that is secured to existing wall 14 and a sliding support member 778 that is slidably retained within base support 776. Base support 776 is identical with base support 76 except that inwardly extending second wall 790*a* of each base support 776 includes a J-shaped extension wall 779 having a first wall 779*a* that is coplanar with and forms an outward extension of second wall 790*a*, a second wall 779*b* that extends at right angles outwardly from the free end of first wall 779*a* and which functions as a stop limit for the edge of the respective wall panel 12, and a third wall 779*c* which turns inwardly at a right angle from second wall 779*b* and which engages within a slot 12*d* of a wall panel 12.

An end extrusion 723 includes a base section 746 that seats flush against and is secured to existing wall 14. A first wall 725 extends upwardly from base section 746, and a second J-shaped extension wall 727 has a first wall 727*a* that is in parallel, spaced relation to base section 746, second wall 727*b* that extends at right angles outwardly from the free end of first wall 727*a* and which functions as a stop limit for the edge of the respective wall panel 12, and a third wall 727*c* which turns inwardly at a right angle and which engages within a slot 12*d* of a wall panel 12.

In assembling wall panels 12 with this arrangement, base supports 776 are first secured to wall panel 12 in spaced apart relation, as shown, by screws 84 through openings 782 in base supports 776. It will be appreciated that adjacent base supports 776 are assembled such that L-shaped retaining walls 786*a* are closest to each other. Support members 778, which are identical to support members 78, are then assembled in sliding relation with base supports 776 as discussed above, with wing plates 796*b* positioned entirely in spaces 792 between second walls 790*b* and base plate 780. An adhesive member 798, which can be a double sided tape, an adhesive or any other securing means, is secured on top of each inverted U-shaped plate 794 of sliding support members 778, for securement of wall panels 12 thereon. Then, each wall panel 12, with its sliding support member 778 secured thereto, is slid in its base support 776 to the positions shown in FIG. 37 toward each other until third walls 779*c* of J-shaped extension walls 779 engage within slots 12*d* of adjacent wall panels 12.

Then, end extrusions 723 are assembled with the opposite sides of wall panels 12 such that third walls 727*c* of second J-shaped extension walls 727 engage within slots 12*d* at the opposite side edges of wall panels 12. Thereafter, screws 750 are inserted through openings 748 in base sections 746 to secure end extrusions 723 in position. The construction then continues to the left and/or right in FIG. 37 in the same manner.

In order to assemble wall panels 12 in covering relation to existing wall 14, reference is made to FIGS. 38-44 which utilizes the construction of the embodiment of FIGS. 19-25, with the understanding that this method is applicable to all of the above embodiments.

Figures 38, 39, 40, 41:
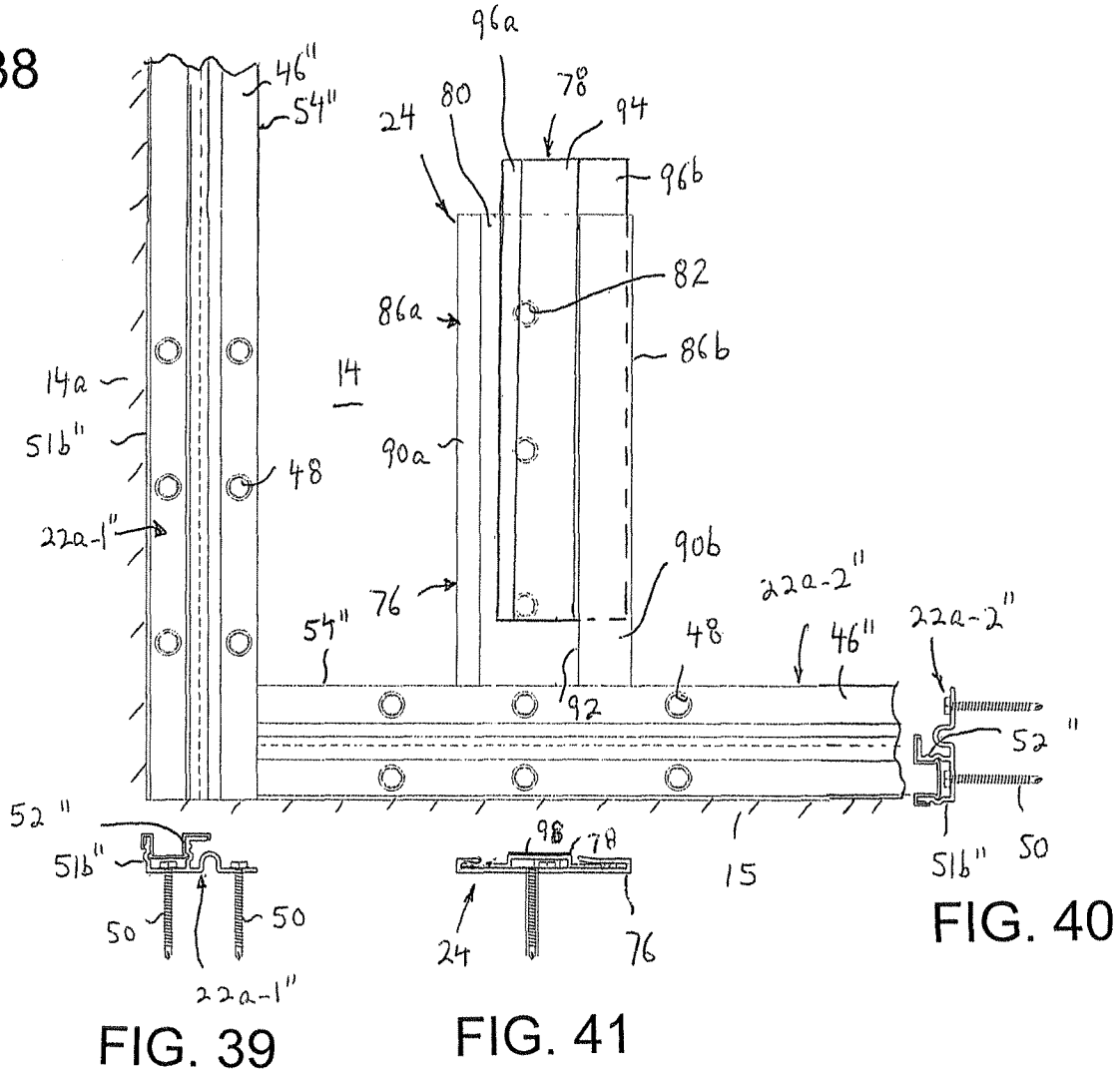
FIG. 38 is a top plan view showing a first step of a method for easily mounting wall panels over an existing wall using the embodiment of FIGS. 19-25.
FIG. 39 is a cross-sectional view of the first corner fastening extrusion of FIG. 38.
FIG. 40 is a cross-sectional view of the second corner fastening extrusion of FIG. 38.
FIG. 41 is a cross-sectional view of the structural support assembly of FIG. 38.

A first corner fastening extrusion 22*a*-1" is first secured to existing wall 14, as shown in FIGS. 38 and 39, by screws 50 through openings 48 thereof (or other fastening members such as double sided tape or the like) adjacent a corner where existing wall 14 meets another existing wall 14*a*. In such case, wall 51*b*" of first corner fastening extrusion 22*a*-1" is positioned in abutting relation to adjacent existing wall 14*a*. Then, a second corner fastening extrusion 22*a*-2" is secured to existing wall 14, as shown in FIGS. 38 and 40, by screws 50 through openings 48 thereof adjacent a corner where existing wall 14 meets a floor (or ceiling) 15, and with an end edge of second corner fastening extrusion 22*a*-2" abutting against the free edge 54" of base section 46" of first corner fastening extrusion 22*a*-1" and with wall 51*b*" of second corner fastening extrusion 22*a*-2" positioned in abutting relation to floor 15.

The base support 76 of one or more structural support assemblies 24 is secured to existing wall 14 in parallel, spaced relation to first corner fastening extrusion 22*a*"-1, with L-shaped retaining wall 86*a* being closer to corner fastening extrusion 22*a*-1", and with one end edge of the base support 76 abutting against the free edge 54" of base section 46" of second corner fastening extrusion 22*a*-2".

Thereafter, a sliding support member 78 is assembled with its base support 76 by angling sliding support member 78 slightly to slide wing 96*b* into the space 92 between the base plate 80 and second wall 90*b*. At such time, the free end of wing 96*a* is positioned in spaced relation from the free edge of second wall 90*a*, as shown in FIGS. 38 and 41, and in the manner shown in FIG. 11. In this position, sliding support member 78 is also offset in the lengthwise direction from its base support 76, as shown in FIG. 38. Then, an adhesive member 98, which can be a double sided tape, an adhesive or any other securing means, is secured on top of inverted U-shaped plate 94.

Figure 42:
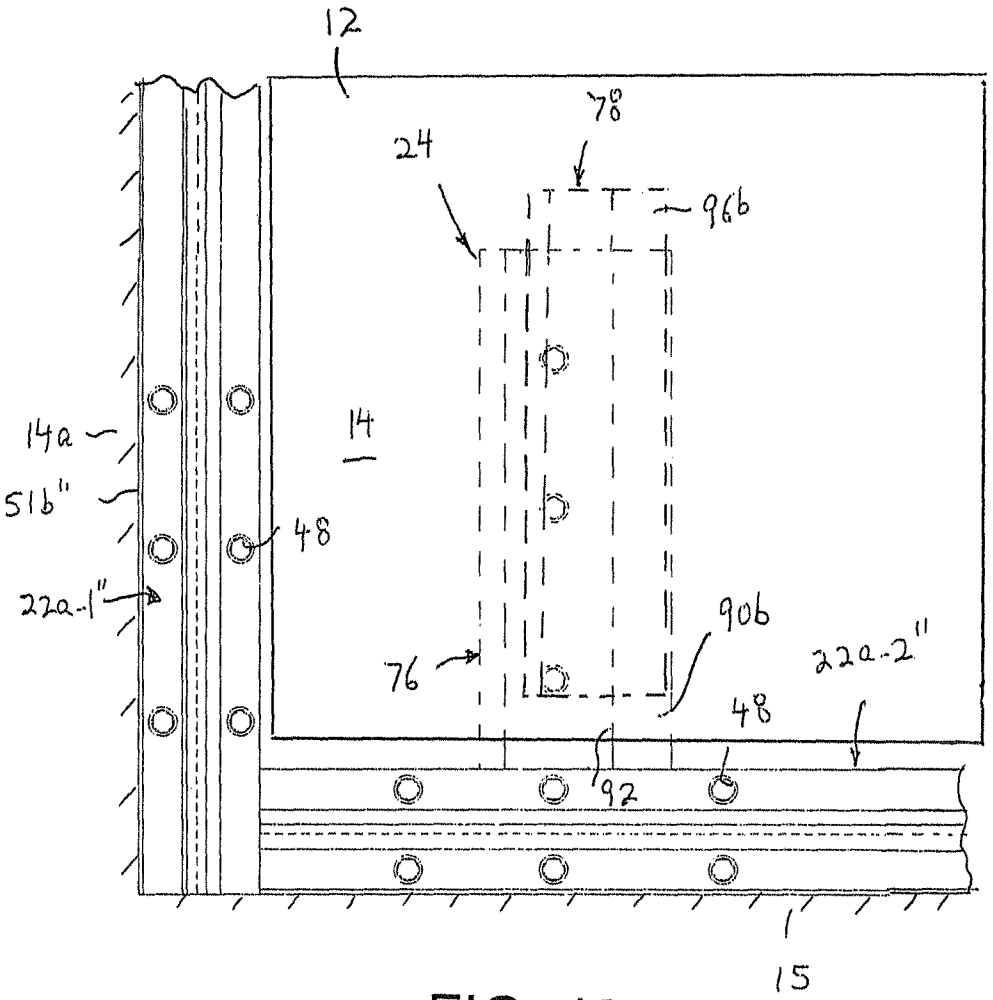
FIG. 42 is a top plan view showing a second step of the method for easily mounting wall panels over an existing wall using the embodiment of FIGS. 19-25.

The thin aluminum wall 18 of one wall panel 12 is then secured to the top of the inverted U-shaped plate 94 of at least one sliding support member 78 by the adhesive member 98. In such position, the leftmost free edge of wall panel 12, as viewed in FIG. 42, is in spaced relation to first corner fastening extrusion 22*a*-1" and the lower edge of wall panel 12, as viewed in FIG. 42, is in spaced relation to second corner fastening extrusion 22*a*-2".

Figures 43, 44:
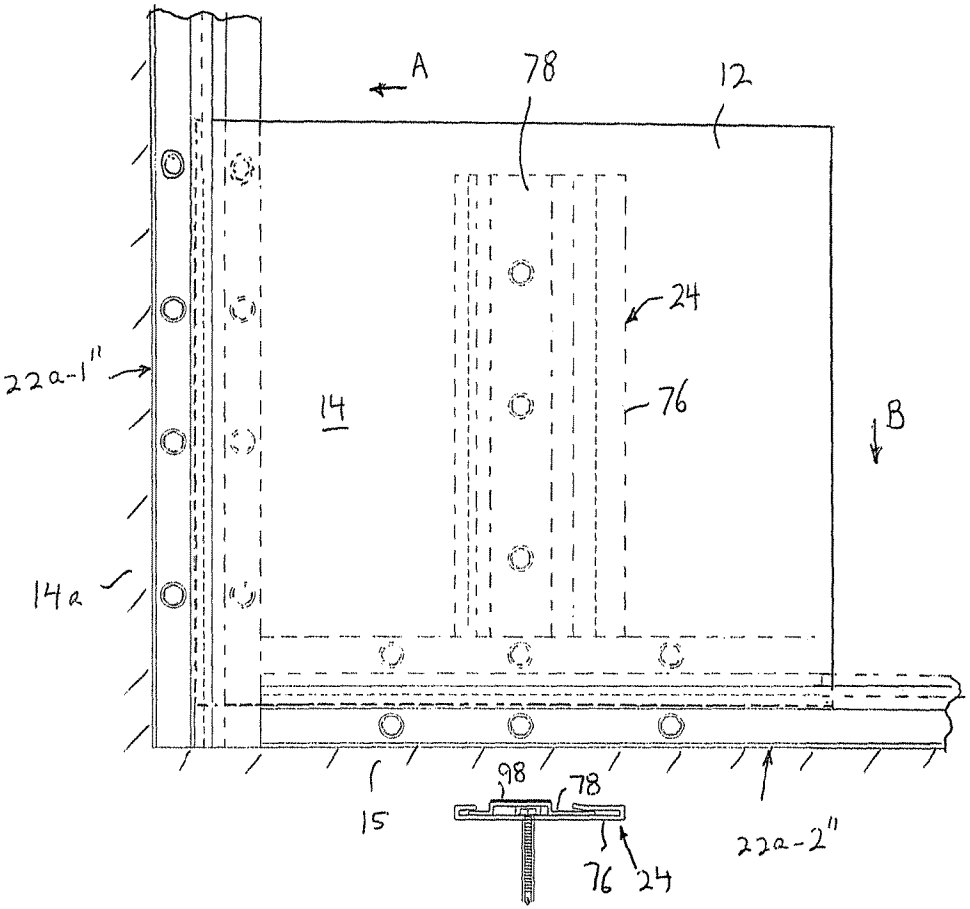
FIG. 43 is a top plan view showing a third final step of the method for easily mounting wall panels over an existing wall using the embodiment of FIGS. 19-25.
FIG. 44 is a cross-sectional view of the structural support assembly of FIG. 43.

Thereafter, wall panel 12 is pushed to the left in the direction of arrow A and down in the direction of arrow B in FIG. 43, so that the left side edge of the wall panel 12 is in abutting relation with the respective bent end retaining wall 52" of first corner fastening extrusion 22*a*-1" and the lower edge of wall panel 12 is in abutting relation with the respective bent end retaining wall 52" of second corner fastening extrusion 22*a*-2". At the same time, sliding support member 78 is moved with wall panel 12 in the direction of arrow A to the left to the position shown in FIG. 44 so that both wings 96*a* and 96*b* are positioned in spaces 92 and also downwardly in the direction of arrow B.

Then, in the manner shown in FIGS. 0.2 and 4, a main fastening extrusion 20" (FIGS. 20 and 21) has its leftmost retaining wall 32" abutted up against the opposite end of the wall panel 12 such that this opposite free end of wall panel 12 seats on top of arcuate bend 37" and beneath holding section 36". Further, an end edge of this main fastening extrusion 20" is abutted against the free edge 54" of base section 46" of second corner fastening extrusion 22*a*-2". Screws 30 are then used to secure main fastening extrusion 20" to existing wall 14. This locks wall panel 12 tightly in position between first and second corner fastening extrusions 22*a*-1" and 22*a*-2" and main fastening extrusion 20".

Thereafter, the base support 76 of one or more structural support assemblies 24 is secured to existing wall 14 in spaced relation from this main fastening extrusion 20" with an end edge thereof abutted against the free edge 54" of base section 46" of second corner fastening extrusion 22*a*-2".

At the opposite side of the already assembled main fastening extrusion 20", a new wall panel 12 is assembled in the same manner as discussed above with respect to corner fastening extrusion 22*a*-1", with a respective sliding support member 78 secured to this new wall panel 12 being slid over to the left in the direction of arrow A and downward in the direction of arrow B until the left side edge of the new wall panel 12 is in abutting relation with the other bent end retaining wall 32" of the assembled main fastening extrusion 20" and the lower edge of the new wall panel 12 is in abutting relation with the respective bent end retaining wall 52" of second corner fastening extrusion 22*a*-2".

This operation continues until the opposite corner wall 14*a* is reached, as shown in FIG. 19, at which time, a new corner fastening extrusion 22" is assembled therewith.

Then, an elongated main fastening extrusion 20" is assembled on wall 14 with the upper edges of the already assembled wall panels 12, such that the upper edges of the already assembled wall panels 12 are in abutting relation to one retaining wall 32" thereof and captured between the respective arcuate bend 37" and holding section 36". Then, the operation continues, on the opposite upper side of this new main fastening extrusion 20" starting at the left side with corner fastening extrusion 22*a*-1", in the manner discussed above, until the entire existing wall 14 is covered by wall panels 12.

Closure members 60*a*" are then assembled with all main fastening extrusions 20" and corner fastening extrusions 22*a*-1" and 22*a*-2".

As a result, wall panels 12 are securely and tightly held in place without any play between main fastening extrusions 20 and corner fastening extrusions 22, and locked in position.

Of course, it will be appreciated that the wall panels 12 can be removed by a reverse operation to that described above.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A system for mounting wall panels to an existing wall, comprising:

a plurality of fastening extrusions, each fastening extrusion including:

an extrusion base section adapted to be secured to the existing wall, at least one extrusion retaining wall extending at an angle from said base section, and a holding member on each retaining wall; and a plurality of intermediary supports for supporting the wall panels at a position between side edges of the wall panels, each said intermediary support including:

an intermediary support base adapted to be secured to the existing wall, said intermediary support base including:

a base plate adapted to be secured to the existing wall, a first support base retaining wall connected with a first side of said base plate, and a second support base retaining wall connected with a second opposite side of said base plate, an opening defined between inner ends of said first and second support base retaining walls in a widthwise direction of said intermediary support base; and a sliding member adapted to be slidably connected with said base plate, such that one said wall panel is adapted to be secured on said sliding member for sliding movement relative to the intermediary support base with said sliding member in order to slide a side edge of the wall panel into one said fastening extrusion between said extrusion base section and said holding member, said sliding member having a first widthwise dimension between outer lengthwise edges thereof which permits entry of said sliding member within said first and second support base retaining walls through said opening and which permits widthwise sliding adjustment of said sliding member between said first and second support base retaining walls.

2. A system for mounting wall panels to an existing wall according to claim 1, wherein the holding member of each fastening extrusion includes one of:

an enlarged section extending along an upper end of each retaining wall; and a hold down wall connected at the upper end of each retaining wall and extending in spaced relation with the extrusion base section.

3. A system for mounting wall panels to an existing wall according to claim 1, wherein said at least one fastening extrusion includes:

at least one corner fastening extrusion, and at least one main fastening extrusion.

4. A system for mounting wall panels town existing wall according to claim 1, wherein at least one fastening extrusion includes two parallel, spaced apart retaining walls extending at an angle from said base section, with each retaining wall including one said holding member.

5. A system for mounting wall panels to an existing wall according to claim 1, wherein at least one said fastening extrusion includes a bend in the extrusion base section thereof which is bent toward a respective said holding member to form a gap therebetween to receive one side edge of one wall panel.

6. A system for mounting wall panels to an existing wall according to claim 1, wherein:

each wall panel is formed by a core with a thin metal wall covering opposite sides thereof; and at least one said fastening extrusion includes a bulge in at least one said retaining wall thereof against which only said core is adapted to engage in order to allow for thermal expansion of said thin metal walls.

7. A system for mounting wall panels to an existing wall according to claim 1, further including a closure member for covering each said fastening extrusion, said closure member engaging at least one of:

at least one said retaining wall, and at least one said holding member.

8. A system for mounting wall panels to an existing wall according to claim 1, wherein:

said sliding member includes:

a central member dimensioned to fit between said first and second support base retaining walls, a first wing member at a first side of said central member for engagement within said first support base retaining wall, and a second wing member at a second opposite side of said central member for engagement within said second support base retaining wall, and said second widthwise dimension is defined between outer free lengthwise edges of said first and second wing members.

9. A system for mounting wall panels to an existing wall according to claim 1, further including a thermal insulation member for positioning between the existing wall and at least one of:

at least one said extrusion base, and at least one said intermediary support base.

10. A system for mounting wall panels to an existing wall according to claim 1, further including a furring member connected between the existing wall and at least one of:

at least one said fastening extrusion, and at least one said intermediary support.

11. A system for mounting wall panels to an existing wall according to claim 10, wherein each furring member includes:

at least one foot wall adapted to be connected to the existing wall, at least one spacing wall having one end connected to the at least one foot wall and extending in a direction transverse to the at least one foot wall and the existing wall, and a connection wall connected to an opposite end of the at least one spacing wall and extending in a direction transverse to the at least one spacing wall for connection to at least one of:

at least one said fastening extrusion, and at least one said intermediary support.

12. A system for mounting wall panels to an existing wall, comprising:

a plurality of fastening extrusions, each fastening extrusion including:

an extrusion base section adapted to be secured to the existing wall, at least one extrusion retaining wall extending at an angle from said base section, and a holding member on each retaining wall; and a plurality of intermediary supports for supporting the wall panels at a position between side edges of the wall panels, each said intermediary support including:

an intermediary support base adapted to be secured to the existing wall, said intermediary support base including:

a base plate adapted to be secured to the existing wall, a first support base retaining wall connected with a first side of said base plate, and a second support base retaining wall connected with a second opposite side of said base plate, said first and second support base retaining walls each have a widthwise dimension, and the widthwise dimension of said first support base retaining wall is less than the widthwise dimension of said second support base retaining wall, and a sliding member adapted to be slidably connected with said base plate, such that one said wall panel is adapted to be secured on said sliding member for sliding movement relative to the intermediary support base plate with said sliding member in order to slide a side edge of the wall panel into one said fastening extrusion between said extrusion base section and said holding member, said sliding member including:

a central member dimensioned to fit between said first and second support base retaining walls, a first wing member at a first side of said central member for engagement within said first support base retaining wall, and a second wing member at a second opposite side of said central member for engagement within said second support base retaining wall, and said first and second wing members each have a widthwise dimension, and the widthwise dimension of said first wing member is less than the widthwise dimension of said second wing member.

13. A method for mounting wall panels to an existing wall, with a system of the type including a plurality of fastening extrusions, each fastening extrusion including an extrusion base section adapted to be secured to the existing wall, at least one retaining wall extending at an angle from said base section, and a holding member on each retaining wall; a plurality of intermediary supports for supporting the wall panels at a position between side edges thereof, each said intermediary support including an intermediary support base adapted to be secured to the existing wall, and a sliding member adapted to be slidably connected with said intermediary support base, such that one said wall panel is adapted to be secured on said sliding member for sliding movement relative to the intermediary support base with said sliding member in order to slide a side edge of the wall panel into one said fastening extrusion between said extrusion base section and said holding member, said method comprising the steps of:

a) securing a first said fastening extrusion to the existing wall;

b) securing the intermediary support base of at least one said intermediary support to the existing wall in spaced relation from said first fastening extrusion;

c) slidably assembling a sliding member with the secured intermediary support base so that the sliding member is positioned to one side in the intermediary support base in a direction away from said first fastening extrusion;

d) securing one said wall panel on said sliding member for sliding movement relative to the intermediary support base with said sliding member, such that one side edge of said wall panel is in spaced relation to one said retaining wall of said first fastening extrusion;

e) moving said wall panel toward said first fastening extrusion such that said sliding member moves to an opposite side of said intermediary support base and such that said one side edge of said wall panel is moved into at least close abutment to one said retaining wall of said first fastening extrusion below the holding member thereof;

f) positioning a second said fastening extrusion against the existing wall, such that an opposite side edge of the wall panel is in at least close abutment to one said retaining wall of said second fastening extrusion; and g) continually repeating steps b)-f).

14. A method for mounting wall panels to an existing wall according to claim 13, wherein the first said fastening extrusion is a corner fastening extrusion and the second said fastening extrusion is a main fastening extrusion.

15. A method for mounting wall panels to an existing wall according to claim 13, further including the step of assembling a closure member with at least one of one said holding member and one said retaining member of the respective fastening extrusion.

16. A method for mounting wall panels to an existing wall according to claim 13, further including the steps of:

h) securing a third said fastening extrusion to the existing wall at right angles to the first fastening extrusion prior to said step a); and i) moving said wall panel toward said third fastening extrusion when said wall panel is moved toward said first fastening extrusion such that one end edge of said wall panel is moved into at least close abutment to one said retaining wall of said third fastening extrusion below the holding member thereof.

* * * * *